US007616909B2

(12) United States Patent
Kato et al.

(10) Patent No.: US 7,616,909 B2
(45) Date of Patent: Nov. 10, 2009

(54) IMAGE FORMING APPARATUS AND IMAGE FORMING METHOD

(75) Inventors: Shinji Kato, Kanagawa (JP); Shin Hasegawa, Kanagawa (JP); Hitoshi Ishibashi, Kanagawa (JP); Kohta Fujimori, Kanagawa (JP); Nobutaka Takeuchi, Kanagawa (JP); Osamu Ariizumi, Kanagawa (JP); Naoto Watanabe, Kanagawa (JP); Kayoko Tanaka, Tokyo (JP); Yushi Hirayama, Kanagawa (JP); Kazumi Kobayashi, Kanagawa (JP); Shinji Kobayashi, Kanagawa (JP); Fukutoshi Uchida, Kanagawa (JP); Takashi Enami, Kanagawa (JP); Ryohta Morimoto, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 146 days.

(21) Appl. No.: 11/733,918

(22) Filed: Apr. 11, 2007

(65) Prior Publication Data

US 2008/0025742 A1 Jan. 31, 2008

(30) Foreign Application Priority Data

May 24, 2006 (JP) ..... 2006-143819

(51) Int. Cl.

| | |
|---|---|
| ***G03G 15/00*** | (2006.01) |
| ***G03G 15/01*** | (2006.01) |
| ***G03G 15/20*** | (2006.01) |
| ***G03G 15/08*** | (2006.01) |

(52) U.S. Cl. ..... 399/49; 399/301; 399/303; 399/313; 399/121; 399/107

(58) Field of Classification Search ..... 399/49, 399/72, 124, 125, 165, 301, 121, 303, 313; 347/116

See application file for complete search history.

(56) References Cited

U.S. PATENT DOCUMENTS 5,198,861 A 3/1993 Hasegawa et al.

(Continued)

FOREIGN PATENT DOCUMENTS

JP 2642351 5/1997

(Continued)

OTHER PUBLICATIONS

U.S. Appl. No. 11/932,198, filed Oct. 31, 2007, Takeuchi, et al.
U.S. Appl. No. 12/112,525, filed Apr. 30, 2008, Koizumi, et al.

*Primary Examiner*—David M Gray
*Assistant Examiner*—Rodney Bonnette
(74) *Attorney, Agent, or Firm*—Oblon, Spivak, McClelland, Maier & Neustadt, L.L.P.

(57) ABSTRACT

In an image forming apparatus, a toner image formed on a photosensitive drum is primarily transferred onto an intermediate transfer belt. The toner image on the intermediate transfer belt is secondarily transferred onto a transfer material by a secondary transfer roller in contact with the intermediate transfer belt. A relation A>B>C is satisfied, where A is a width of the intermediate transfer member, B is a width of the secondary transfer member, and C is a width of the transfer material. The intermediate transfer member includes a patch-pattern forming area that is not contacted by the secondary transfer member. The image forming apparatus includes a reflection-type photosensor that detects a patch pattern formed in the patch-pattern forming area.

18 Claims, 22 Drawing Sheets

U.S. PATENT DOCUMENTS

| | | | | |
|---|---|---|---|---|
| 5,327,196 | A | 7/1994 | Kato et al. | |
| 5,387,965 | A | 2/1995 | Hasegawa et al. | |
| 5,475,476 | A | 12/1995 | Murai et al. | |
| 5,612,771 | A * | 3/1997 | Yamamoto et al. | 399/301 |
| 5,630,195 | A | 5/1997 | Sawayama et al. | |
| 5,761,570 | A | 6/1998 | Sawayama et al. | |
| 5,860,038 | A | 1/1999 | Kato et al. | |
| 6,055,386 | A | 4/2000 | Kato et al. | |
| 6,081,678 | A | 6/2000 | Kato | |
| 6,181,892 | B1 | 1/2001 | Fujimori | |
| 6,526,235 | B2 | 2/2003 | Kato | |
| 6,529,695 | B2 | 3/2003 | Katayanagi et al. | |
| 6,741,827 | B2 * | 5/2004 | Lee | 399/313 |
| 6,816,178 | B2 * | 11/2004 | Yamada et al. | 347/116 |
| 7,055,928 | B2 | 6/2006 | Ishibashi et al. | |
| 7,130,561 | B2 * | 10/2006 | Iikura et al. | 399/111 |
| 7,139,511 | B2 | 11/2006 | Ishibashi | |
| 7,190,912 | B2 | 3/2007 | Kato | |
| 2003/0210412 | A1 | 11/2003 | Ishibashi | |
| 2004/0228663 | A1 * | 11/2004 | Kamiya et al. | 399/301 |
| 2004/0251435 | A1 | 12/2004 | Sawayama et al. | |
| 2005/0147424 | A1 | 7/2005 | Kato et al. | |
| 2005/0185988 | A1 * | 8/2005 | Mochimaru | 399/165 |
| 2006/0002724 | A1 | 1/2006 | Fujimori et al. | |
| 2006/0024076 | A1 * | 2/2006 | Kato et al. | 399/49 |
| 2006/0285863 | A1 * | 12/2006 | Noguchi et al. | 399/49 |

FOREIGN PATENT DOCUMENTS

| | | |
|---|---|---|
| JP | 10-161388 | 6/1998 |
| JP | 2002-123052 | 4/2002 |
| JP | 2002-132097 | 5/2002 |
| JP | 2003-167394 | 6/2003 |

* cited by examiner

| FIG. 8A |
| --- |
| FIG. 8B |

| FIG. 9A | FIG. 9B |
| --- | --- |
| FIG. 9C | FIG. 9D |

IMAGE FORMING APPARATUS AND IMAGE FORMING METHOD

CROSS-REFERENCE TO RELATED APPLICATIONS

The present document incorporates by reference the entire contents of Japanese priority document, 2006-143819 filed in Japan on May 24, 2006. The present document incorporates by reference the entire contents of Japanese application, 2005-297660 filed in Japan on Oct. 12, 2005.

BACKGROUND OF THE INVENTION

1. Field of the Invention

The present invention relates to an image forming apparatus.

2. Description of the Related Art

Among image forming apparatuses, there is one type of apparatus that charges and writes an image onto an image carrier by rotating the image carrier having a drum shape or a belt shape, thereby forming an electrostatic latent image, adheres a toner to the latent image to visualize the image to form a toner image by a developing device, and then directly transfers the toner image onto a transfer material such as paper and an overhead projector (OHP) film to form the image thereon. There is also an image forming apparatus that indirectly transfers an image onto a transfer material via a belt-shaped intermediate image transfer unit, for example, thereby forming the image on the transfer material.

The latter image forming apparatus primarily transfers an image formed on an image carrier such as a photosensitive unit onto an intermediate transfer unit such as an intermediate transfer belt to form an image thereon using a primary transfer unit such as a primary transfer roller. The apparatus secondarily transfers the image on the intermediate transfer unit onto a transfer material such as paper to form the image, using a secondary transfer unit such as a secondary transfer roller provided in contact with the intermediate transfer unit.

This image forming apparatus includes two types of multicolor image forming apparatuses below.

A first image forming apparatus called a revolver type or a rotary type apparatus sequentially forms images of different colors onto one image carrier, sequentially primarily transfers and superimposes the images onto an intermediate transfer unit to form a multicolor image, and collectively secondarily transfers the images onto a transfer material to form a multicolor image on the transfer material.

A second image forming apparatus called a tandem apparatus has plural imaging stations along an intermediate transfer unit, forms images of different colors onto respective image carriers at these imaging stations, sequentially primarily transfers these images onto an intermediate transfer unit to form a multicolor image, while running the intermediate transfer unit, and collectively secondarily transfers the image onto a transfer material to form a multicolor image, using a secondary transfer unit.

These types of image forming apparatuses used to form multicolor images containing full colors are required to stably achieve image quality including color reproducibility. To meet the above requirement, there is a method of forming a concentration detection pattern image, what is called a patch pattern, on an intermediate transfer unit, optically reading the patch pattern using an optical detector, and feedback controlling various kinds of parameters used for an image forming condition based on a result of the reading, as disclosed in Japanese Patent Application Laid-open No. H10-161388.

In the feedback control, an image concentration sensor as an optical detector measures the amount of a toner forming a patch pattern adhered to an intermediate transfer unit. When a measuring result does not meet a predetermined condition, various kinds of parameters are adjusted to meet this predetermined condition. For example, a writing output characteristic, a charge characteristic of an image carrier, a charge characteristic affecting the adhesiveness of a toner in a developer, and a developing bias characteristic to control the adhesion amount of the toner are adjusted.

A patch pattern is formed larger than a detection range detected by the optical detector, on the intermediate transfer unit. A saturated part of the output from the optical detector, that is, a part where a patch pattern is formed in the whole range detected by the optical detector is measured. The amount of adhesion of the toner is calculated based on a result of the detection. The calculated amount of adhesion of the toner is used to determine predetermined concentration, and is also used to calculate a timing of formation of each color patch pattern. The calculated timing of formation of a patch pattern is used to determine a position of forming each color image.

As a concentration control method according to a measurement of patch pattern concentration, there is a method as disclosed in Japanese Patent Application Laid-open No. 2002-132097. There is also a method disclosed in Japanese Patent No. 2642351 regarding the control of an image position (a positional deviation due to color misregistration) based on a detection of a position of a patch pattern.

A patch pattern is formed in constant concentration in an area not superimposed with a starting end of the next image forming area, separately from the original image forming area. Therefore, when a patch pattern is formed to measure concentration or detect a position, a patch pattern as an image not yet transferred is transferred onto a secondary transfer unit in a secondary transfer nip that brings the secondary transfer unit into contact with an intermediate transfer unit. Consequently, there is a risk that the toner transferred to the secondary transfer unit is adhered to the back surface of a transfer material passing through the secondary transfer nip, resulting in staining of the back surface of the transfer material.

Therefore, to avoid the staining of the back surface of the transfer material, conventionally, when a patch pattern is formed, the secondary transfer unit is separated from the intermediate transfer unit when the patch pattern passes through the secondary transfer nip. In other words, as shown in a flowchart in FIG. 17, an image formation is started at S1. When the timing is determined as a process control timing at S2, the secondary transfer unit is separated at S3 after the secondary transfer of a normal image ends. At S4, an image forming condition of a patch pattern is changed according to need. At S5, a patch pattern is generated. When all patch patterns are detected at S6, a result of detecting the patch patterns is feedback to the control at S7. At S8, the secondary transfer unit is contacted. At S9, when there is further an image forming job, the process returns to S1. When there is no image forming job, the process ends.

When the timing is not the process control timing at S2, the secondary transfer bias is switched to antipolarity to turn in idle in a state that the secondary transfer unit is brought into contact with the intermediate transfer unit between the transfer material and the secondary transfer unit, at S10. With this arrangement, the toner adhered to the secondary transfer unit is adhered to the intermediate transfer unit to execute cleaning. The process proceeds to S9. When there is an image forming job, the process returns to S1. When there is no more image forming job, the process ends. According to this method, when four gradation patterns are used for each color, a pattern layout shown in FIG. 18 is used.

In FIG. 18, reference numeral 1 denotes a belt-shaped intermediate transfer unit, 2 denotes a normal-image forming area, 3 denotes a roller-shaped secondary transfer unit, and 4 denotes an optical detector supported by a supporting member 5. Py1, Py2, Py3, and Py4 denote patch patterns of four gradations of yellow formed on the intermediate transfer unit 1, and Pc1 and Pc2 denote a part of patch patterns of four gradations of cyan formed on the intermediate transfer unit 1.

In detecting a patch pattern, when a configuration for canceling the secondary transfer process is used as described above, and when a secondary transfer roller is used as a secondary transfer unit as disclosed in Japanese Patent Application Laid-open No. 2002-123052, the secondary transfer roller is separated from the intermediate transfer unit. Therefore, it is necessary to set time required for this separation, and a distance of conveying a transfer material to be used a secondary transfer is increased.

Specifically, this operation is carried out at a timing shown in FIG. 19. Therefore, according to the conventional method, an image is formed after the secondary transfer unit is separated to prevent the influence to the image. Consequently, substantial downtime occurs.

In separating the secondary transfer unit to be used for the second transfer, oscillation due to this operation occurs in the intermediate transfer unit. As a result, there occurs a disturbance in an optical relationship with the optical detector at the time of detecting concentration of the patch patterns executed in the canceled state of the second transfer process. In other words, an optical distance is disturbed. This results in an error in the concentration detection.

To avoid the above inconvenience, the process relating to the image formation is once stopped after the image forming process. The roller is separated in this state, and concentration of patch patterns is detected in the state that the process relating to the image formation is started. In this way, the influence of oscillation generated in the intermediate transfer unit can be avoided. According to this method, however, a lapse time due to the stop of the process and restarting increases considerably, and there is a risk of increase in the user waiting time. Particularly, when the optical detector is disposed opposite to the extension part of the intermediate transfer unit as disclosed in Japanese Patent Application Laid-open No. 2002-123052 and Japanese Patent Application Laid-open No. 2003-167394, for example, oscillation of the intermediate transfer unit gives a large influence.

When the secondary transfer roller is used as a secondary transfer unit to solve the inconvenience of staining the back surface of the transfer material, a cleaning device that removes the toner adhered to the secondary transfer roller is also provided. However, in this case, the separate provision of the cleaning device becomes a hindrance to reduction of the space and the size of the image forming apparatus. Accordingly, this hinders cost reduction.

On the other hand, the patch pattern provides information concerning an image of each color, and all images need to be formed before the secondary transfer is started. However, when the secondary transfer is started to shorten the image forming process time, there is a risk that the patch pattern of the final color is not formed. This has the inconvenience that an optimum patch pattern forming condition is hindered by the start of the secondary transfer.

SUMMARY OF THE INVENTION

It is an object of the present invention to at least partially solve the problems in the conventional technology.

According to an aspect of the present invention, an image forming apparatus includes an intermediate transfer member, a primary transfer member that primarily transfers an image formed on an image carrier onto the intermediate transfer member, and a secondary transfer member that secondarily transfers the image on the intermediate transfer member onto a transfer material. The secondary transfer member is in contact with the intermediate transfer member. In the image forming apparatus, a relation A>B>C is satisfied, where A is a width of the intermediate transfer member, B is a width of the secondary transfer member, and C is a width of the transfer material that passes through between the intermediate transfer member and the secondary transfer member. The intermediate transfer member includes a patch-pattern forming area that is not contacted by the secondary transfer member. The image forming apparatus further includes an optical detector that detects a patch pattern formed in the patch-pattern forming area.

According to an aspect of the present invention, an image forming method that is applied to an image forming apparatus including an image carrier, an intermediate transfer member, a primary transfer member, a secondary transfer member, and an optical detector, includes the primary transfer member primarily transferring an image formed on the image carrier onto the intermediate transfer member, and the secondary transfer member secondarily transferring the image on the intermediate transfer member onto a transfer material. The secondary transfer member is in contact with the intermediate transfer member. In the image forming method, a relation A>B>C is satisfied, where A is a width of the intermediate transfer member, B is a width of the secondary transfer member, and C is a width of the transfer material that passes through between the intermediate transfer member and the secondary transfer member. The intermediate transfer member includes a patch-pattern forming area that is not contacted by the secondary transfer member. The image forming method further includes the optical detector detecting a patch pattern formed in the patch-pattern forming area.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are explained in detail below with reference to the accompanying drawings.

Figure 1:
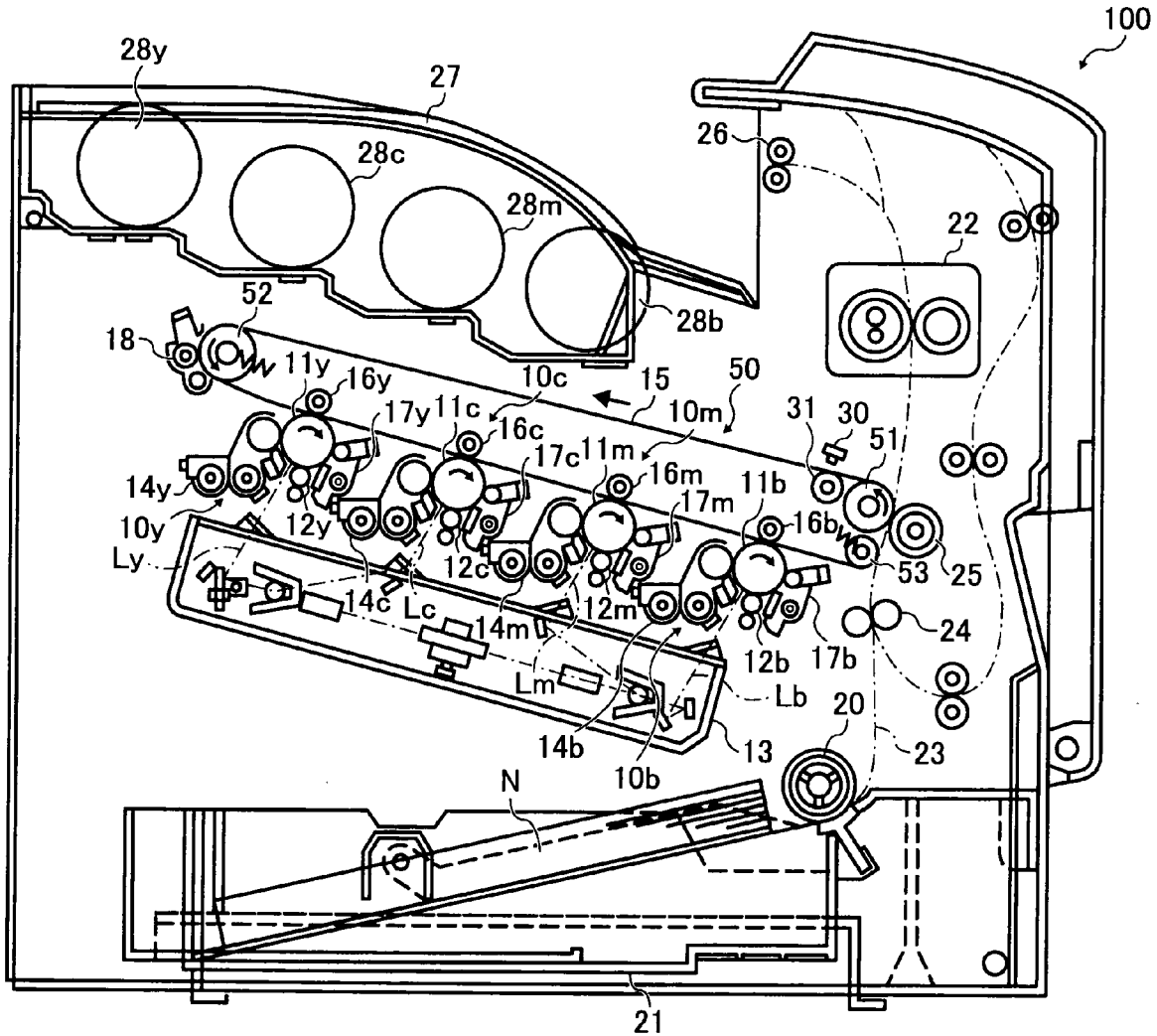
FIG. 1 is a schematic configuration diagram of an internal mechanism of a tandem-type full-color image forming apparatus.

FIG. 1 is a schematic configuration of an internal mechanism of a tandem-type full-color image forming apparatus. In FIG. 1, reference numeral 100 denotes a main body of an image forming apparatus (hereinafter, "apparatus main body").

Four imaging stations 10*y*, 10*c*, 10*m*, and 10*b* of yellow, cyan, magenta, and black are provided along an intermediate transfer belt 15 of an intermediate transfer unit 50, described later, within the apparatus main body 100. The imaging stations include photoconductors 11*y*, 11*c*, 11*m*, and 11*b* as drum-shaped image carriers, respectively, and include charging units 12*y*, 12*c*, 12*m*, and 12*b*, developing units 14*y*, 14*c*, 14*m*, and 14*b*, and primary cleaning units 17*y*, 17*c*, 17*m*, and 17*b*, around the imaging stations, respectively.

Along the clockwise rotation of the photoconductors 11*y*, 11*c*, 11*m*, and 11*b*, the charging units 12*y*, 12*c*, 12*m*, and 12*b* uniformly charge the surfaces of the photoconductors by applying a bias voltage to these surfaces. A common writing unit 13 irradiates laser beams Ly, Lc, Lm, and Lb to these surfaces based on an image signal transmitted from a host device to write images, thereby forming electrostatic latent images on the photoconductors 11*y*, 11*c*, 11*m*, and 11*b*. Thereafter, the developing units 14*y*, 14*c*, 14*m*, and 14*b* apply toners onto the electrostatic images to visualize the images, thereby forming single-color images on the photoconductors 11*y*, 11*c*, 11*m*, and 11*b*.

The intermediate transfer belt 15 having an endless belt shape is run in the counterclockwise direction in contact with the photoconductors 11*y*, 11*c*, 11*m*, and 11*b*, thereby making primary transfer rollers l6*y*, 16*c*, 16*m*, and 16*b* as primary transfer units primarily sequentially transfer the single-color images on the photoconductors 11*y*, 11*c*, 11*m*, and 11*b* onto the intermediate transfer belt 15 as an intermediate transfer unit, starting from a yellow color image. By superimposing the transfer images, a full-color image is formed on the intermediate transfer belt 15.

The intermediate transfer belt 15 is formed as an endless belt, and is applied to a secondary transfer backup roller 51, a cleaning backup roller 52, and a tension roller 53 as members facing the secondary transfer unit. The primary transfer rollers 16*y*, 16*c*, 16*m*, and 16*b* are provided opposite to the photoconductors 11*y*, 11*c*, 11*m*, and 11*b*, via the intermediate transfer belt 15. A secondary cleaning unit 18 is provided opposite to the cleaning backup roller 52 around the intermediate transfer belt 15 via the intermediate transfer belt 15. A secondary transfer roller 25 as a secondary transfer unit is provided opposite to the secondary transfer backup roller 51. With this arrangement, the detachable intermediate transfer unit 50 is collectively configured in the apparatus main body 100.

On the other hand, a feeding roller of a paper feeding device 20 is rotated at a suitable timing to extract a transfer material N from a paper feeding cassette within the apparatus main body 100, and transfer the transfer material N through a transfer-material carrying path 23, thereby bringing the transfer material N into contact with a contact between a pair of resist rollers 24. The pair of resist rollers 24 are rotated by matching the timing with the full color image on the intermediate transfer belt 15. The secondary transfer roller 25 secondarily transfers the full color image onto the transfer material N. Thereafter, after the transfer of the full color image, the transfer material N is passed through the transfer-material carrying path 23, and is carried upwards. When the transfer material N passes through the fixing nip of a fixing device 22, an unfixed transfer toner is fixed in the transfer material N, and the image is finally formed in the transfer material N. The transfer material N is discharged by a discharging roller 26, and is stacked on a discharged-paper stack unit 27 on the apparatus main body 100.

The primary cleaning units 17*y*, 17*c*, 17*m*, and 17*b* clean the photoconductors 11*y*, 11*c*, 11*m*, and 11*b* after the primary transfer ends, thereby removing the residual toner after the transfer, and then initialize these photoconductors. The secondary cleaning unit 18 cleans the intermediate transfer belt 15 after ending the secondary transfer, thereby removing the residual toner after the transfer, and then initializes the intermediate transfer belt 15.

In FIG. 1, reference numerals 28*y*, 28*c*, 28*m*, and 28*b* denote color toner bottles for replenishing toners to the color developing units 14*y*, 14*c*, 14*m*, and 14*b*.

In the image forming apparatus shown in FIG. 1, the secondary transfer nip is formed between the secondary transfer roller 25 as a secondary transfer unit and the intermediate transfer belt 15 as an intermediate transfer unit, which are in contact with each. The image forming apparatus includes a reflection-type photosensor 30 as an optical detector in downstream of the secondary transfer nip in the moving direction of the intermediate transfer belt 15. A backup roller 31 is also provided at the inside of the intermediate transfer belt 15, opposite to the reflection-type photosensor 30. In a small image forming apparatus, it is difficult in many cases to dispose the reflection-type photosensor 30 at the upstream of the secondary transfer nip, due to the layout constraint. Therefore, the reflection-type photosensor 30 is located in the downstream of the secondary transfer nip, like in this example.

Figure 2:
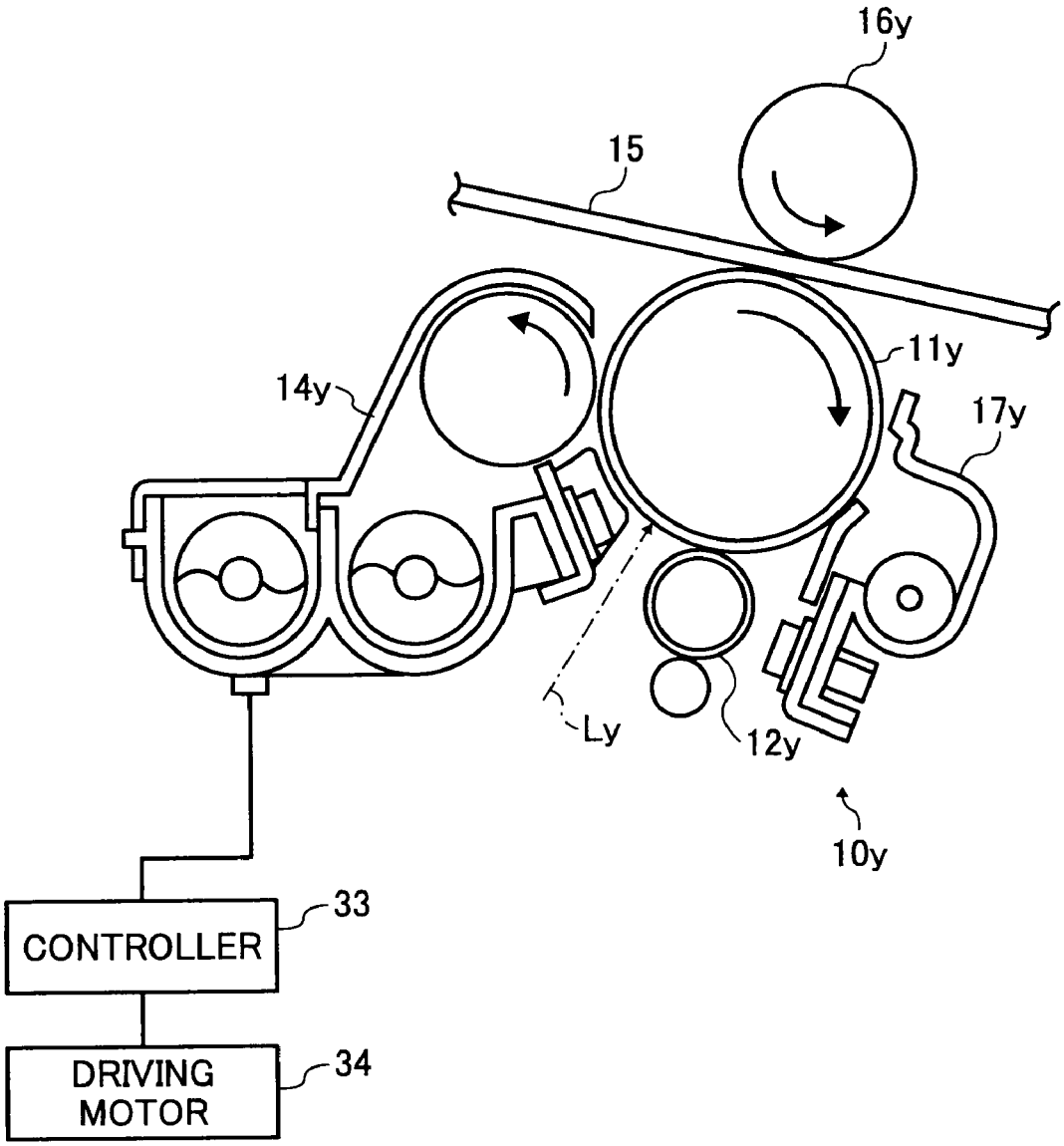
FIG. 2 is an enlarge configuration diagram of an yellow imaging station in the image forming apparatus.

FIG. 2 depicts an enlarged configuration of the yellow imaging station.

As shown in FIG. 2, the primary transfer roller 16*y* and the primary cleaning unit 17*y* are provided around the drum-shaped photoconductor 11*y* via the charging unit 12*y*, the developing unit 14*y*, and the intermediate transfer belt 15. A driving motor 34 is connected to the developing unit 14*y* via a controller 33. Although not shown in the drawings, the imaging stations 10*c*, 10*m*, and 10*b* of cyan, magenta, and black, respectively have exactly the same configuration as that of the yellow imaging station 10*y* shown in FIG. 2, except the colors used.

Figure 3:
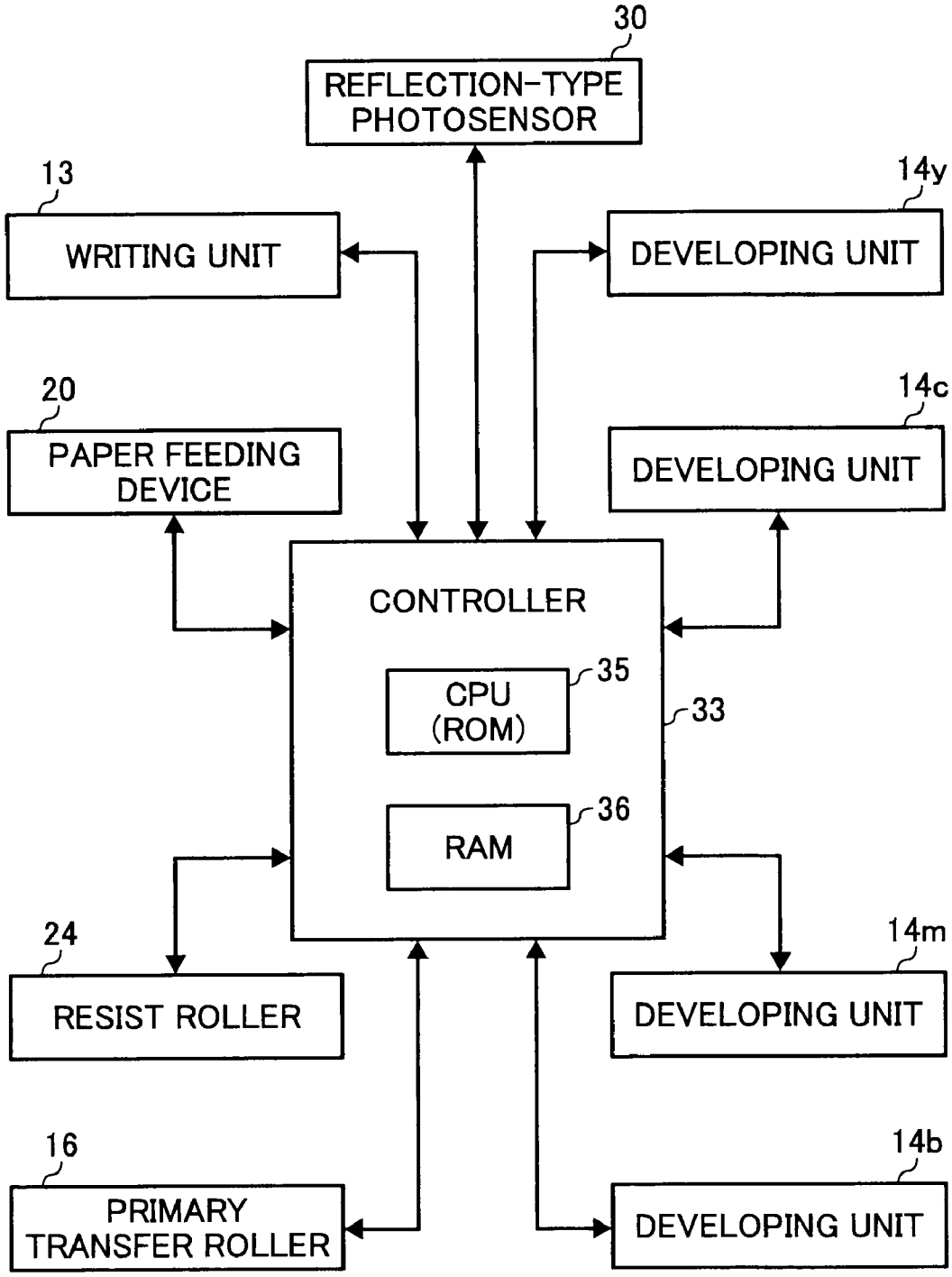
FIG. 3 is a block diagram of a controller provided in the main body of the image forming apparatus.

FIG. 3 is a block diagram of the controller 33 provided in the apparatus main body 100.

The controller 33 includes a microcomputer including a central processing unit (CPU) 35 using a read only memory (ROM) that executes a sequence program and operation relating to the image formation, and a random access memory (RAM) 36 using a nonvolatile memory as a data storage unit. An input and output unit via an interface (not shown) is connected with the developing units 14*y*, 14*c*, 14*m*, and 14*b*, the writing unit 13, the paper feeding device 20, the resist roller 24, a transfer unit having the primary transfer rollers 16*y*, 16*c*, 16*m*, and 16*b*, and the reflection-type photosensor 30.

The reflection-type photosensor 30 can output a signal corresponding to a light reflection rate from the intermediate transfer belt 15, and can obtain a sufficient output value of a difference between a reflection light amount on the surface of the intermediate transfer belt and a reflection light amount from a reference pattern image described later, out of a diffusion light detector and regular reflection light detector. In this example, both a regular reflection type which is advantageous to detect a block toner and an edge of toners of all colors and a diffusion type which is advantageous to detect high concentration part of the color toners are used.

The controller 33 is configured to test the image forming performance or the imaging performance of the developing units 14*y*, 14*c*, 14*m*, and 14*b* at predetermined timings such as a turn-on time of a main power supply unit (not shown), a waiting time after a lapse of a predetermined time, an output time of prints of a predetermined number or more number of sheets of paper, and a waiting time after outputting prints of a predetermined number or more number of sheets of paper.

Specifically, when a predetermined timing is reached, the photoconductors 11*y*, 11*c*, 11*m*, and 11*b* are uniformly charged while rotating these photoconductors. The charging is carried out to gradually increase the potential, unlike a uniform charging (for example, at −700 volts) during the normal printing. The developing units 14*y*, 14*c*, 14*m*, and 14*b* carry out a visible image processing, that is, a developing, while forming electrostatic latent images for reference pattern images by scanning a laser beam L from the writing unit 13.

Based on the above developing, bias development pattern images of various colors, that is, patch patterns, are formed on the photoconductors 11*y*, 11*c*, 11*m*, and 11*b*. During the development, the controller 33 controls to gradually increase the development bias values applied to the development sleeves in the developing units 14*y*, 14*c*, 14*m*, and 14*b*.

Figure 4:
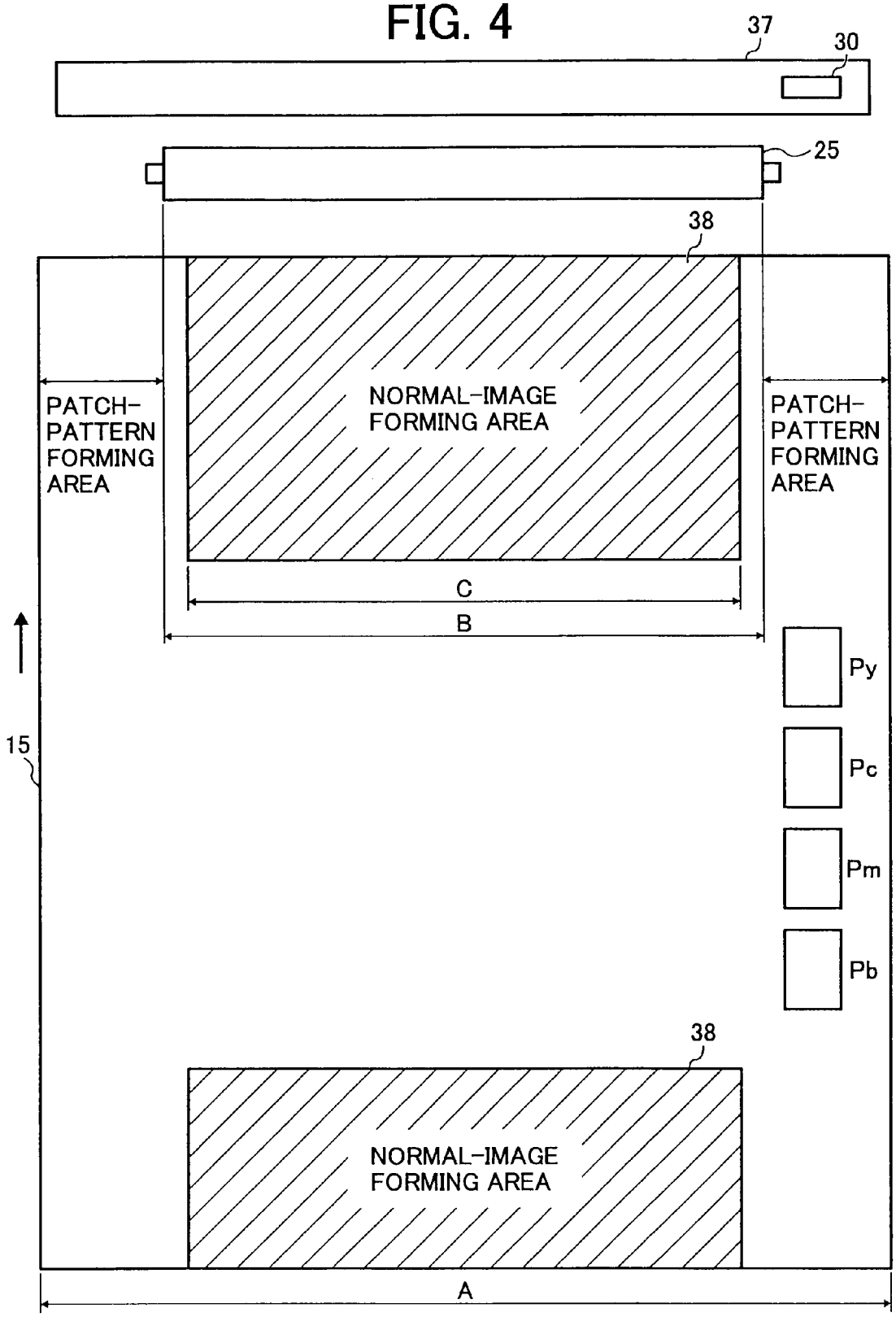
FIG. 4 depicts a positional relationship between an intermediate transfer belt, a secondary transfer roller, and a reflection-type photosensor in the image forming apparatus.

FIG. 4 depicts a positional relationship among the intermediate transfer belt 15, the secondary transfer roller 25, and the reflection-type photosensor supported by a supporting member 37.

As shown in FIG. 4, the intermediate transfer belt 15 has normal-image forming areas 38 provided with a distance between them to avoid mutual superimposition in a moving direction of the intermediate transfer belt 15 as shown by an arrowhead. A width of the intermediate transfer belt 15 as an intermediate transfer unit in a direction orthogonal with the moving direction of the intermediate transfer belt 15 is expressed as A. A width of the secondary transfer roller 25 as a secondary transfer unit is expressed as B. A width of the transfer material N passing through the secondary transfer nip between the intermediate transfer belt 15 and the secondary transfer roller 25 is expressed as C which is the same as the width of the normal-image forming area 38. In this case, a relationship of A>B>C is established.

In addition, a patch-pattern forming area is provided in the area of the intermediate transfer belt 15 which is not touched by the secondary transfer roller 25, that is, the area of A-B. Patch patterns Py, Pc, Pm, and Pb are formed in the touch pattern forming area. The reflection-type photosensor 30 is provided to detect the patch patterns Py, Pc, Pm, and Pb. With this arrangement, even when the patch patterns Py, Pc, Pm, and Pb are formed, the secondary transfer roller 25 is not stained by the untransferred toners.

Specifically, each of the patch patterns Py, Pc, Pm, and Pb is formed in the size of 15 mm (depth)×10 mm (width), and these patch patterns are formed with a distance of 5 millimeters therebetween. Accordingly, the patch patterns Py, Pc, Pm, and Pb on the intermediate transfer belt 15 have a length of 75 millimeters (15 mm×4+5 mm×3=75 mm) in total. The reflection-type photosensor 30 detects the patch patterns Py, Pc, Pm, and Pb. Therefore, the patch patterns are transferred on the intermediate transfer belt 15 without a superimposition of different colors, unlike the toner images of different colors formed during the print process. In the above transfer process, one pattern block including the patch patterns Py, Pc, Pm, and Pb of different colors is formed on the intermediate transfer belt 15.

The intermediate transfer belt 15 as an intermediate transfer unit is formed as an endless belt, and is applied to the secondary transfer backup roller 51 as a secondary-transfer-unit facing member that faces the secondary transfer roller 25 as a secondary transfer unit. The secondary transfer roller 25 is disposed, by matching the mutual center in the width direction to the secondary transfer backup roller 51. By pressing the secondary transfer roller 25 uniformly in the left and right directions, uneven pressure to the end part of the intermediate transfer belt 15 is prevented. When the center of the secondary transfer roller 25 is deviated to the end part instead of the center of the intermediate transfer belt 15, the pressure to the intermediate transfer belt is different at both end parts. Accordingly, the side of the belt to which high pressure is applied has a short running path, resulting in large strength required to pull the belt.

Figure 5:
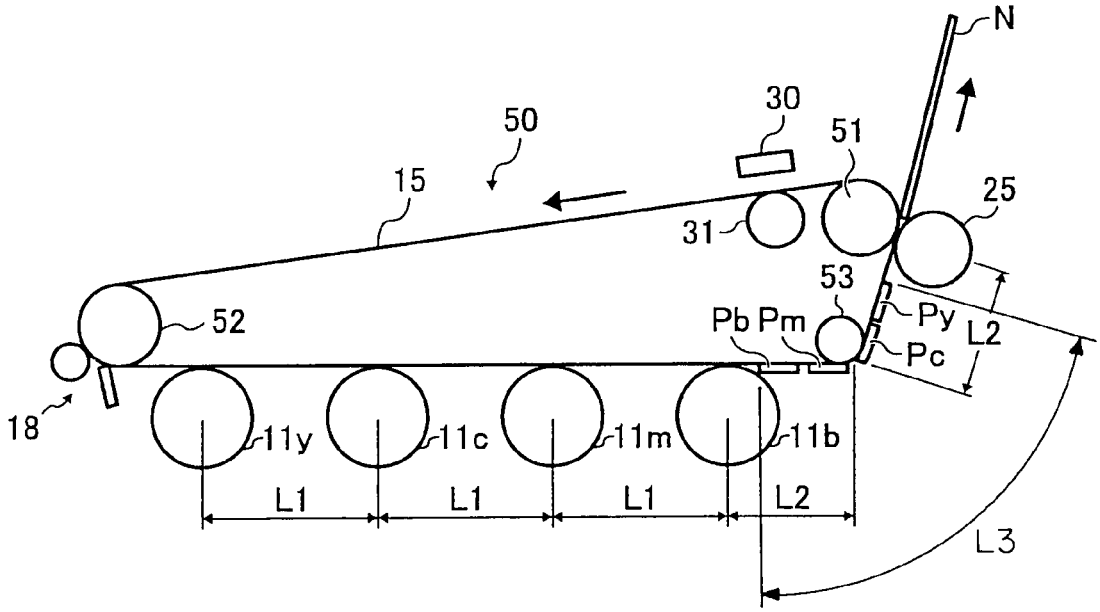
FIG. 5 depicts an installation state of a photoconductor around an intermediate transfer unit in the image forming apparatus.

FIG. 5 depicts an installation state of the photoconductors 11*y*, 11*c*, 11*m*, and 11*b* around the intermediate transfer unit 50.

As shown in FIG. 5, a distance between the photoconductors 11*y*, 11*c*, 11*m*, and 11*b* is set to L1=100 millimeters. A length (L3) of the area in which the patch patterns Py, Pc, Pm, and Pb are formed is set to 75 millimeters. A distance from the center of the photoconductor 11*b* on which the patch pattern Pb of the last color is formed to the tension roller 53 to which the intermediate transfer belt 15 is applied is set to L2=75 mm. A distance from the tension roller 53 to the secondary transfer roller 25, that is, a distance between the tension roller 53 and the secondary transfer backup roller 51 is also set to L2=75 mm.

When the patch patterns Py, Pc, Pm, and Pb pass the position opposite to the reflection-type photosensor 30 along the endless movement of the intermediate transfer belt 15, the light reflection amount is detected, and this is output to the controller 33 (not shown) as an electric signal. The controller 33 (not shown) calculates light reflection rates of the patch patterns Py, Pc, Pm, and Pb, based on data sequentially output from the reflection-type photosensor 30, and stores the light reflection rates into the RAM 36 as concentration pattern data. The secondary cleaning unit 18 cleans the patch patterns Py, Pc, Pm, and Pb that pass the position opposite to the reflection-type photosensor 30.

Figure 6:
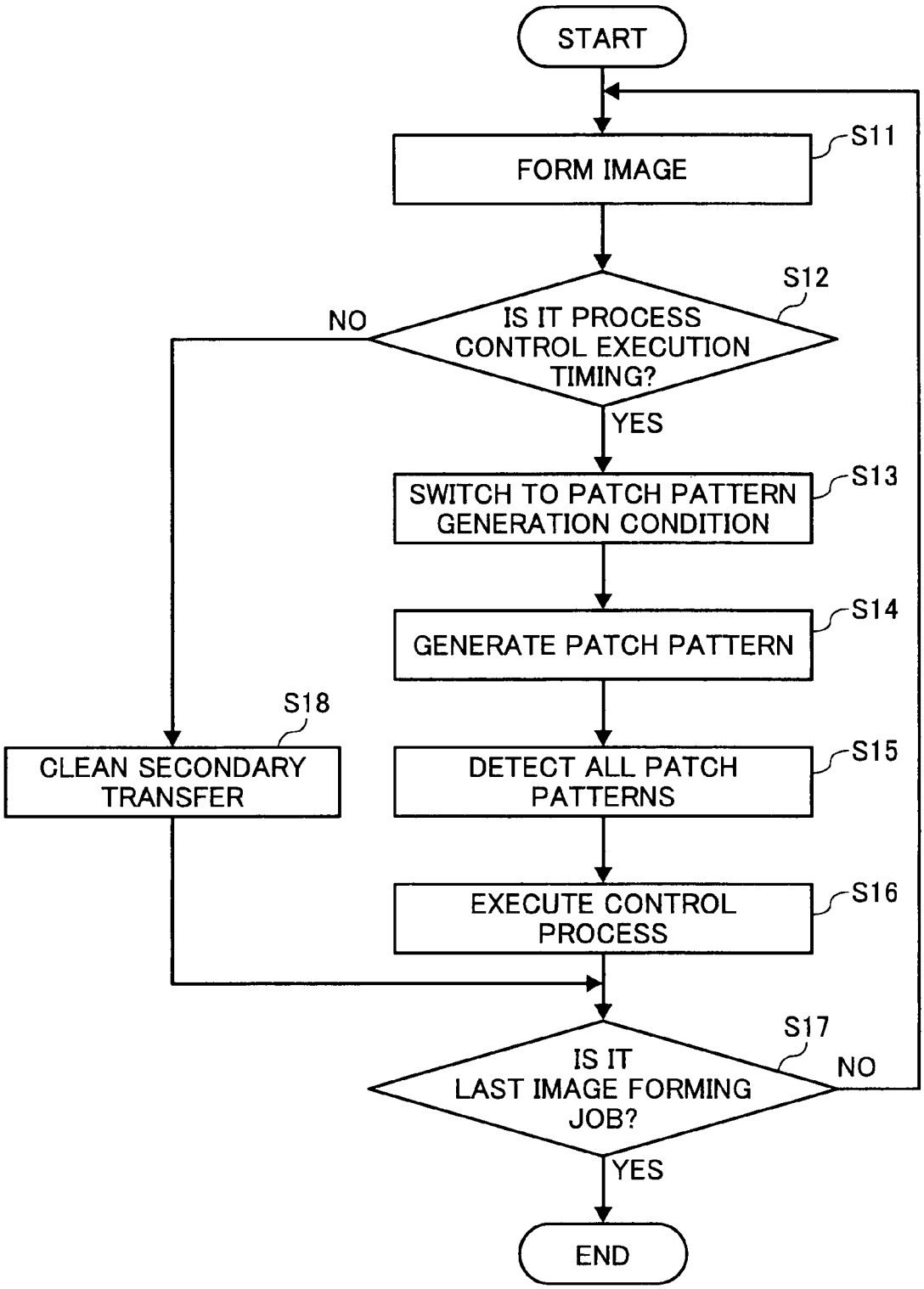
FIG. 6 is a flowchart of a process of detecting concentration and a position of an image using a patch pattern in the image forming apparatus.

FIG. 6 is a flowchart of a process of detecting concentration and a position of an image using a patch pattern in the image forming apparatus.

An image formation is started at S11. When the timing is determined as process control execution timing at S12, the condition is immediately switched to a patch pattern generation condition at S13, without separating the secondary transfer. At S14, the patch patterns Py, Pc, Pm, and Pb are generated. At S15, all patch patterns are detected. At S16, the process control is carried out. Thereafter, the process proceeds to S17, and it is determined whether all the image forming jobs are finished, and when there is still an image forming job (NO at step S17), the process returns to S11. When there is no more image forming job (YES at step S17), the process ends.

When the timing is not the process control timing at S12, the secondary transfer bias is switched to the antipolarity, and the secondary transfer roller 25 is rotated in idle in a state of being in contact with the intermediate transfer belt 15 between the secondary transfer roller 25 and the transfer material. With this arrangement, toners adhered to the secondary transfer roller 25 are adhered to the intermediate transfer belt 15, thereby cleaning the secondary transfer roller 25 (step S18). Thereafter, the process proceeds to S17, and when there is still an image forming job (NO at step S17), the process returns to S11. When there is no more image forming job (YES at step S17), the process ends.

Figure 7:
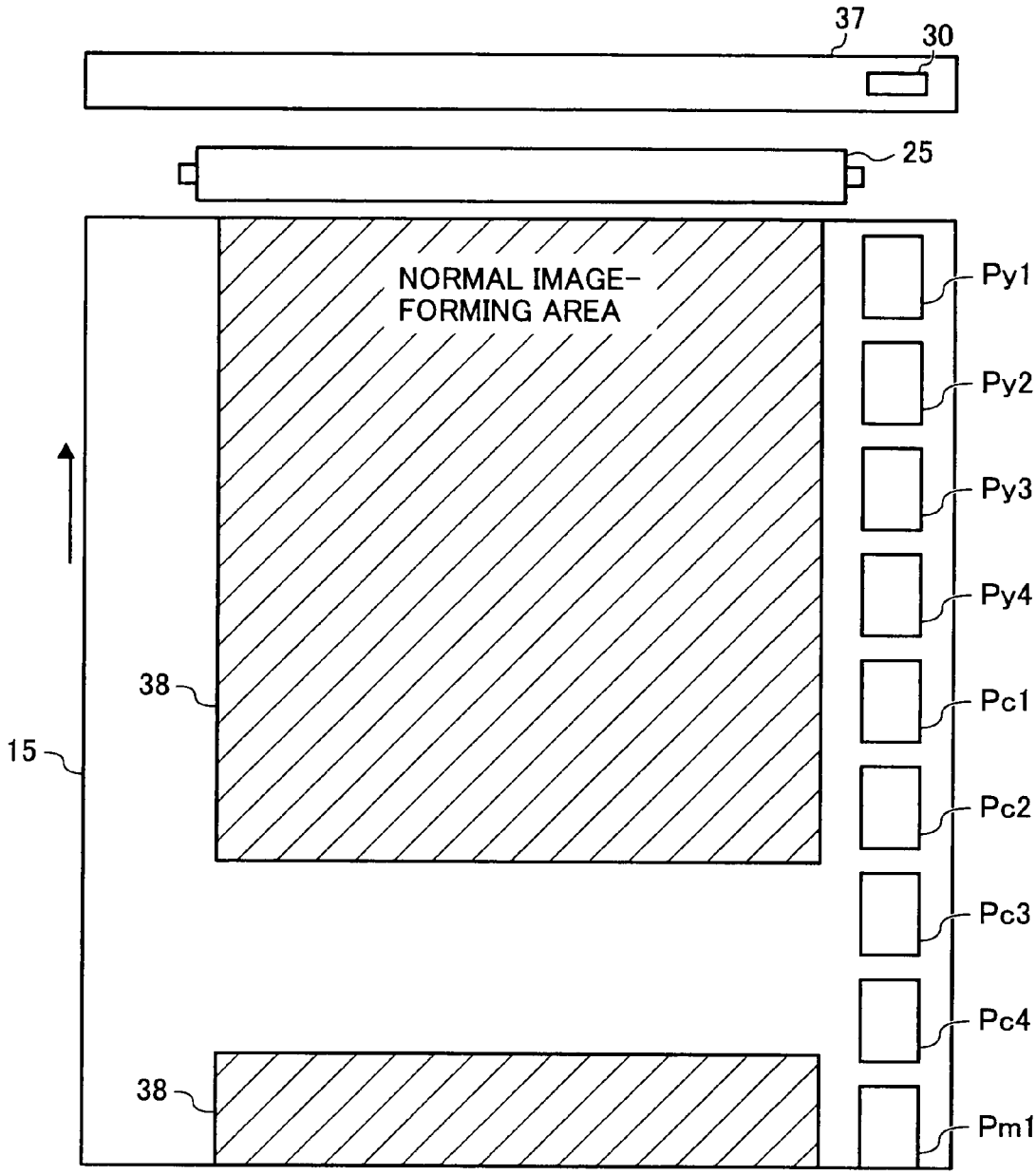
FIG. 7 depicts a part of a pattern layout of the patch pattern.
Figures 8, 8A:
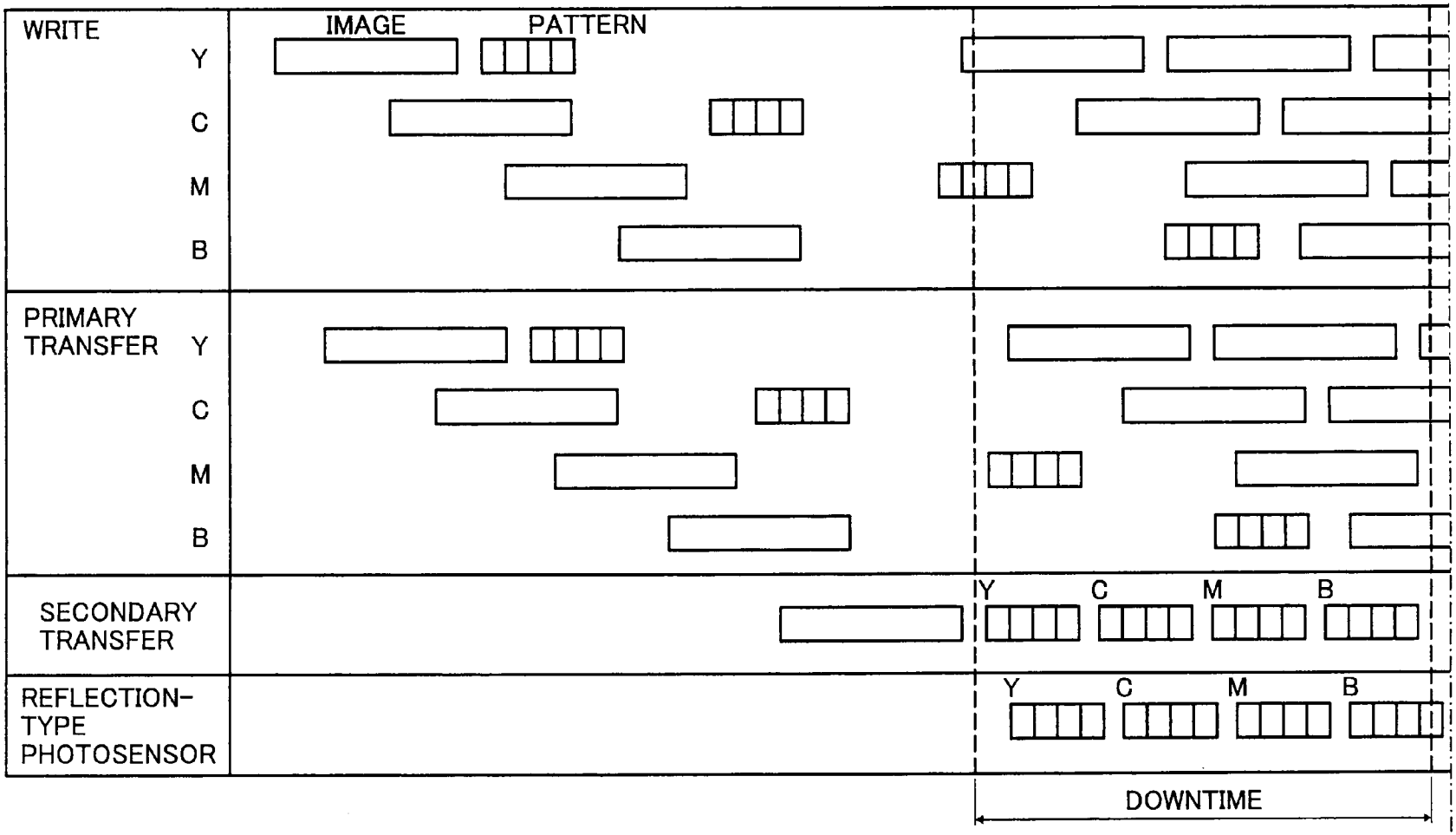
FIG. 8 is a timing chart of the above example.
Figure 8B:
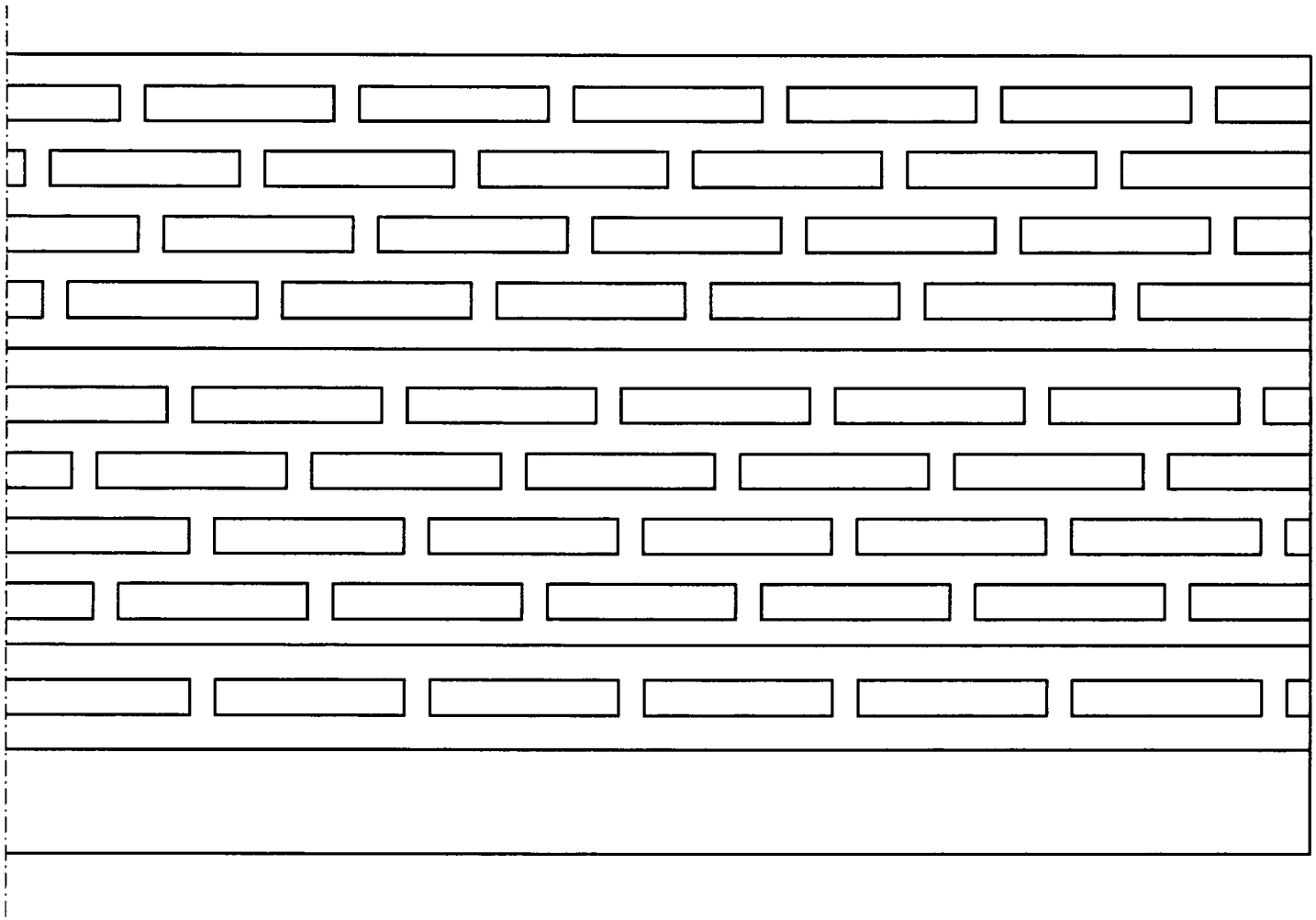

FIG. 7 depicts a part of the layout, and FIG. 8 is a timing chart. In FIG. 7, reference numeral 15 denotes the intermediate transfer belt, 38 denotes the normal-image forming area, 25 denotes the secondary transfer roller, and 30 denotes the reflection-type photosensor supported by the supporting member 37. Py1, Py2, Py3, and Py4 denote four-gradation patch patterns of yellow formed on the intermediate transfer belt 15. Pd1, Pc2, Pc3, and Pc4 denote four-gradation patch patterns of cyan formed on the intermediate transfer belt 15. Pm1 denotes a part of four-gradation patch patterns of magenta formed on the intermediate transfer belt 15.

Figure 19A:
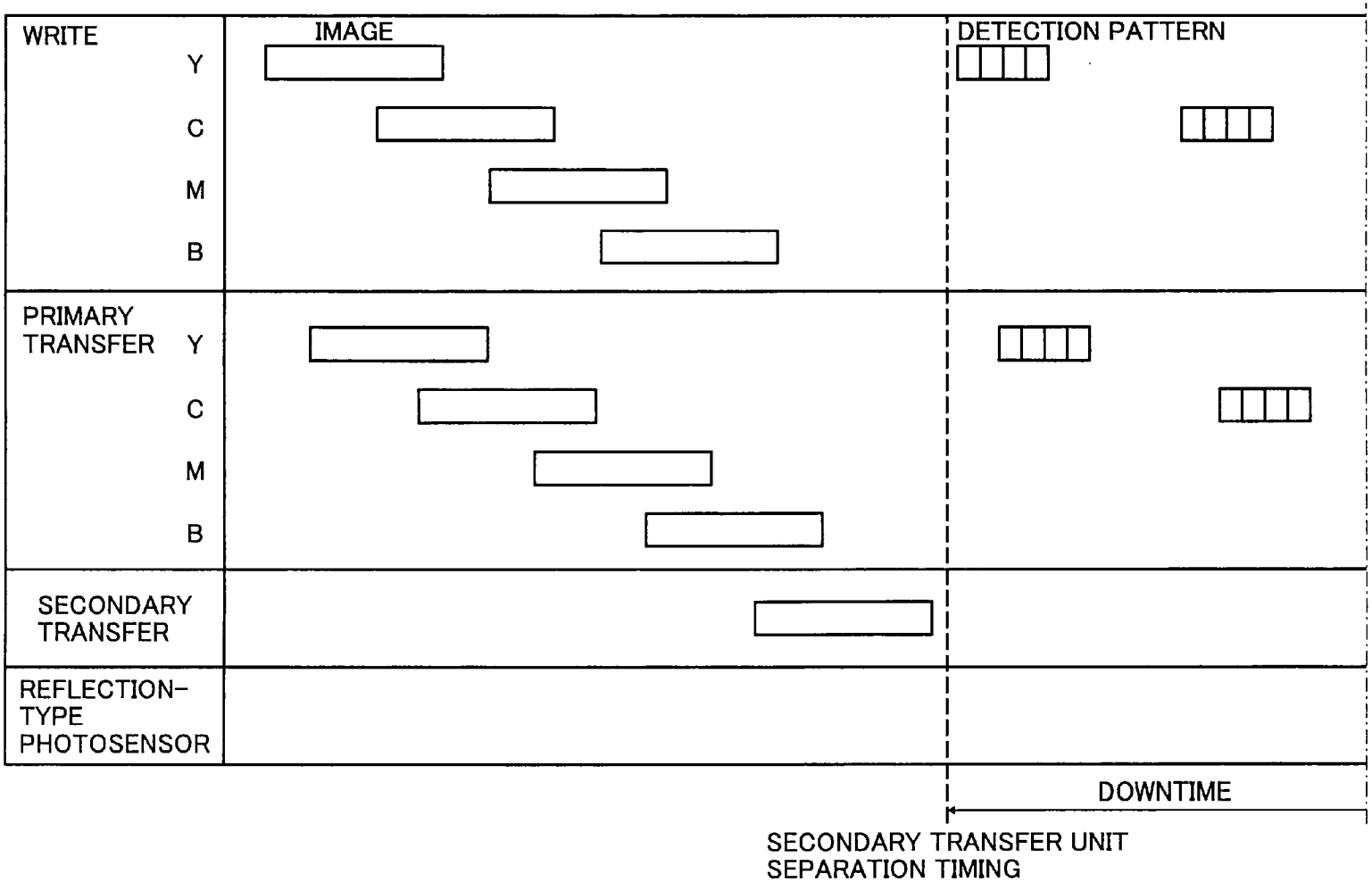
FIG. 19 is a timing chart of the above example.
Figure 19B:
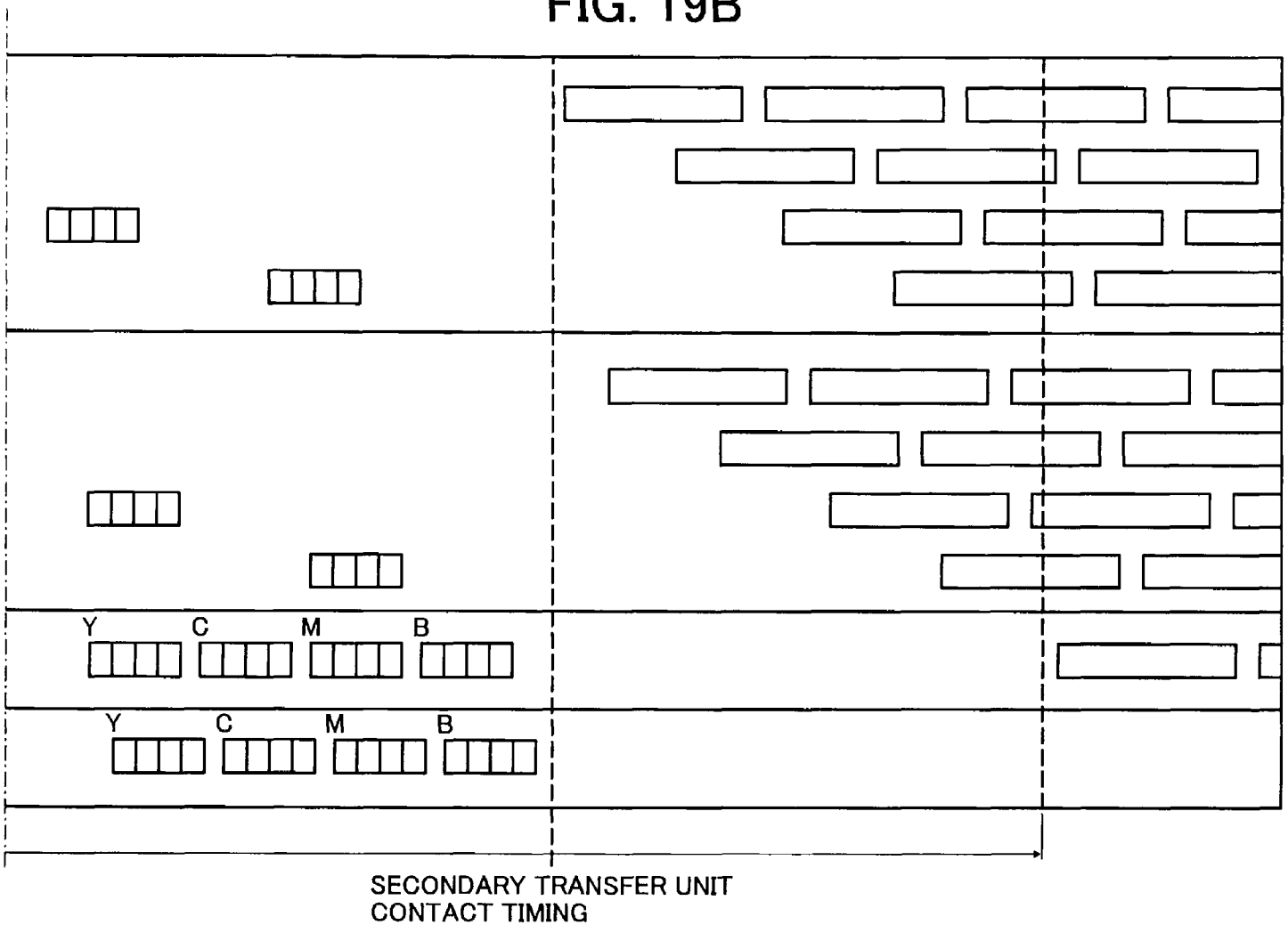

In this case, the imaging condition is switched, that is, the charge potential and the development bias are switched for the generation of patch patterns. Therefore, a normal image of different imaging condition cannot be generated. Therefore, a downtime shown in FIG. 8 occurs. However, this downtime can be decreased to about one third in four-gradation patterns, as is clear from the comparison with the conventional method shown in FIG. 19.

Figures 9, 9A:
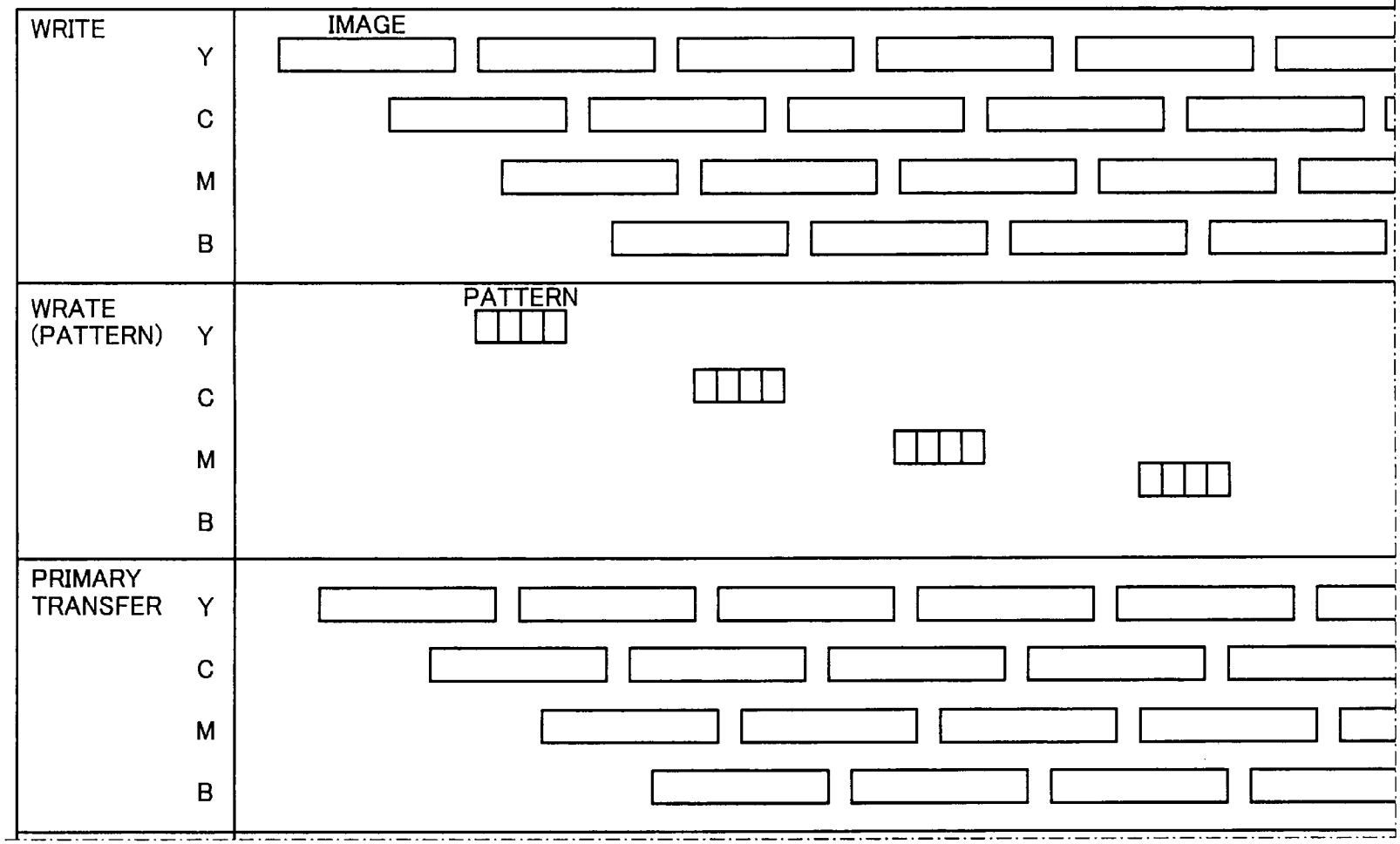
FIG. 9 is a timing chart of another example.
Figure 9B:
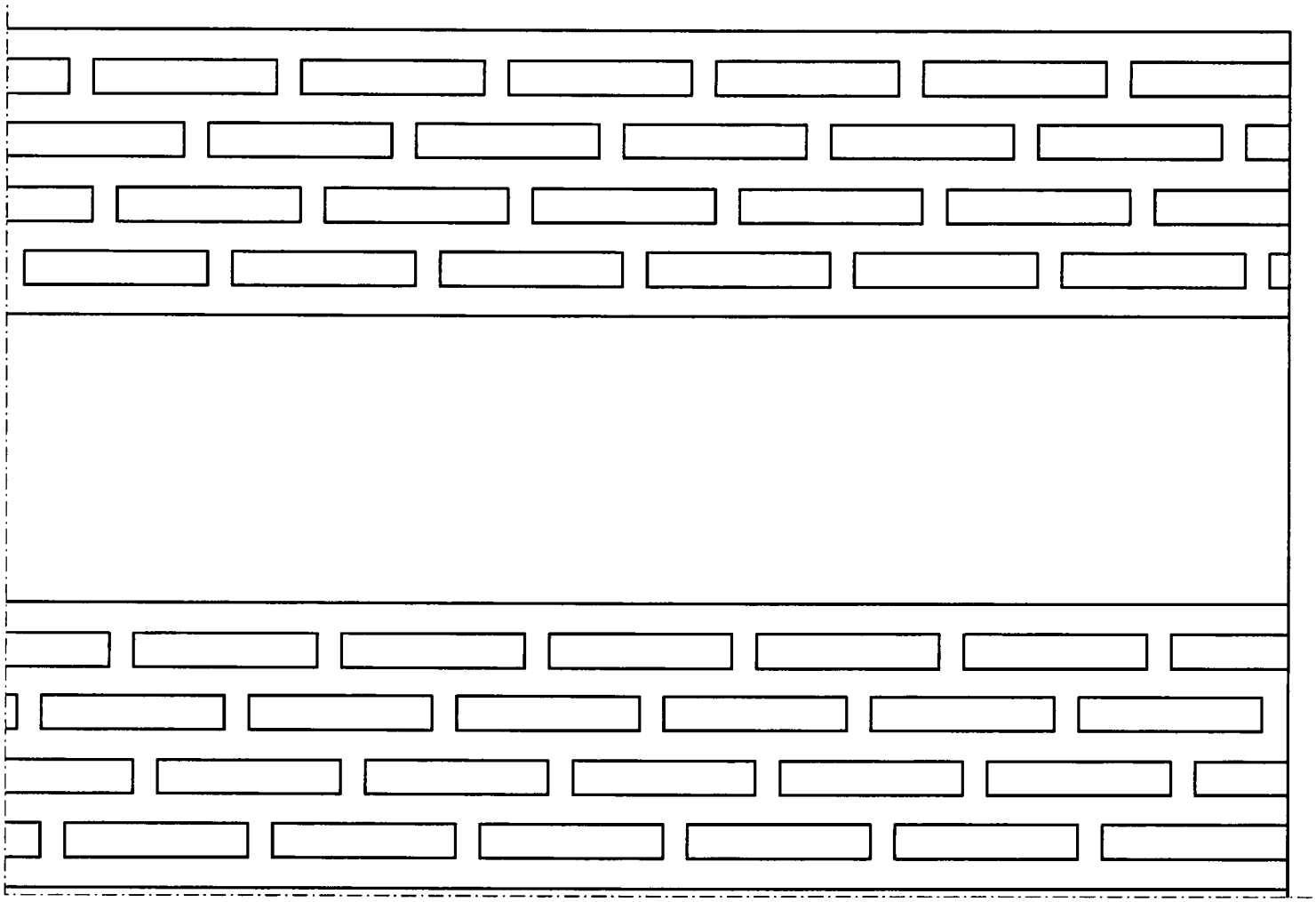
Figure 9C:
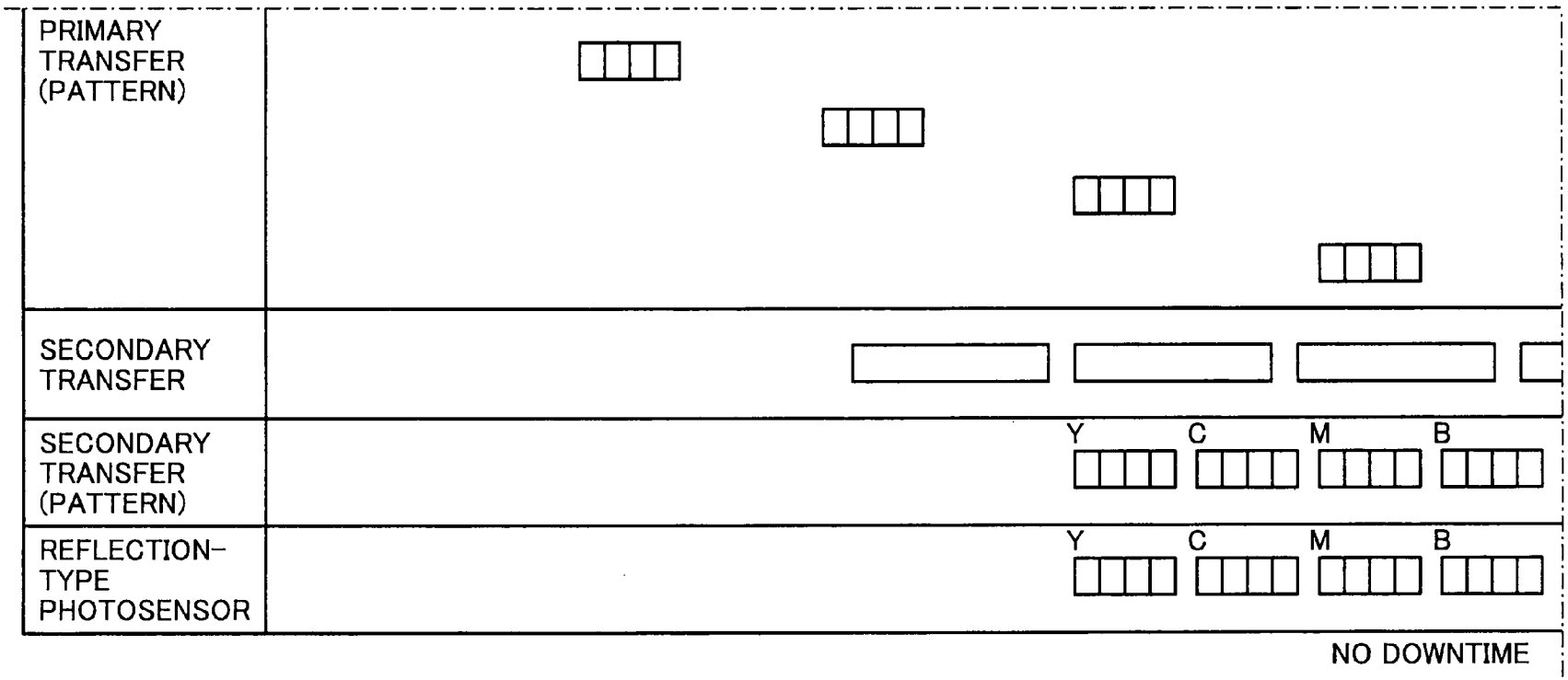
Figure 9D:
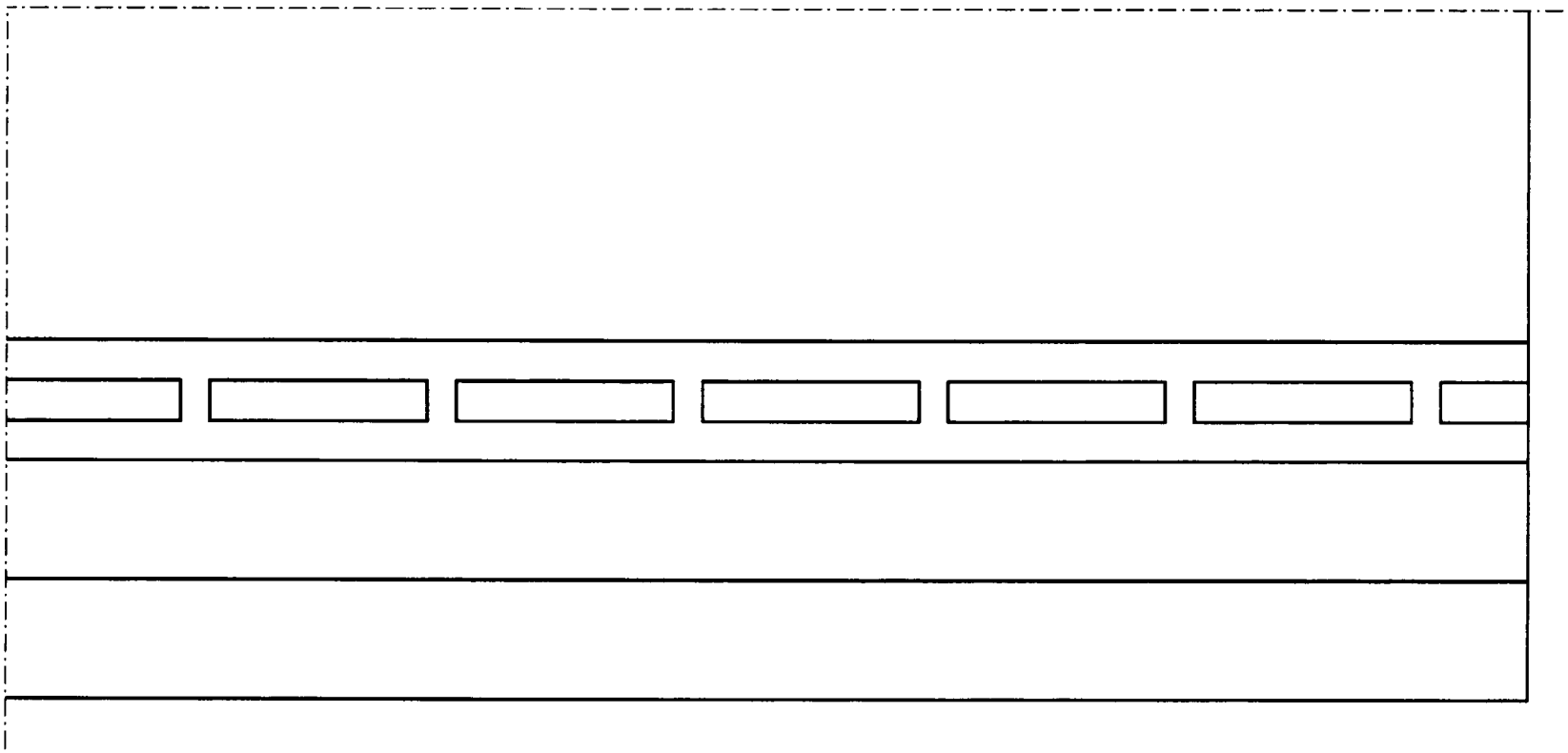

FIG. 9 is a timing chart of another example.

In this example, the imaging condition of the patch pattern imaging, that is, the charge potential and the developing bias are the same as those in the normal image formation. Patch patterns are imaged by switching only the write condition. As shown in FIG. 9, there occurs no downtime in the timing chart, because the patch patterns can be imaged in parallel with the normal image. FIG. 7 depicts the layout of the pattern formation.

Figure 10:
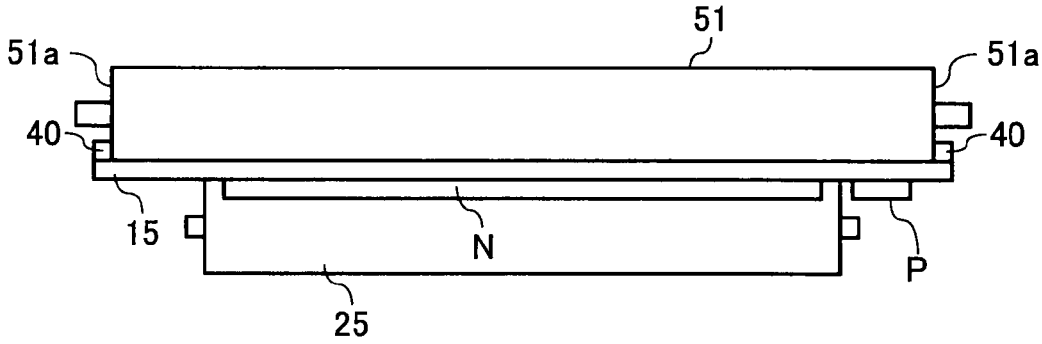
FIG. 10 is a configuration diagram of a secondary fixing nip position.

In the above example, as shown in FIG. 10, the intermediate transfer belt 15 is applied to the secondary transfer backup roller 51. The secondary transfer roller 25 is pressed against the intermediate transfer belt 15 by sandwiching this intermediate transfer belt 15, thereby forming the secondary transfer nip. The transfer material N is conveyed through the secondary transfer nip. The width A of the intermediate transfer belt 15, the width B of the secondary transfer roller 25, and the width C of the transfer material N have the relationship of A>B>C. The patch-pattern forming area is provided in the area of the intermediate transfer belt 15 which is not contacted by the secondary transfer roller 25. The patch pattern P is formed in the patch-pattern forming area.

In this case, the intermediate transfer belt 15 has a positional-deviation preventing member 40 such as a guide tape adhered to the intermediate transfer belt 15 along both ends, as shown in FIG. 10, for example. The intermediate transfer belt 15 is applied to the secondary transfer backup roller 51, by having the positional-deviation preventing member 40 contacted to both end surfaces 51*a* of the secondary transfer backup roller 51. With this arrangement, when the intermediate transfer belt 15 is run, the positional-deviation preventing member 40 is applied to both end surfaces 51*a* of the secondary transfer backup roller 51, thereby preventing the intermediate transfer belt 15 applied to the secondary transfer backup roller 51 from deviating to the width direction.

Figure 11:
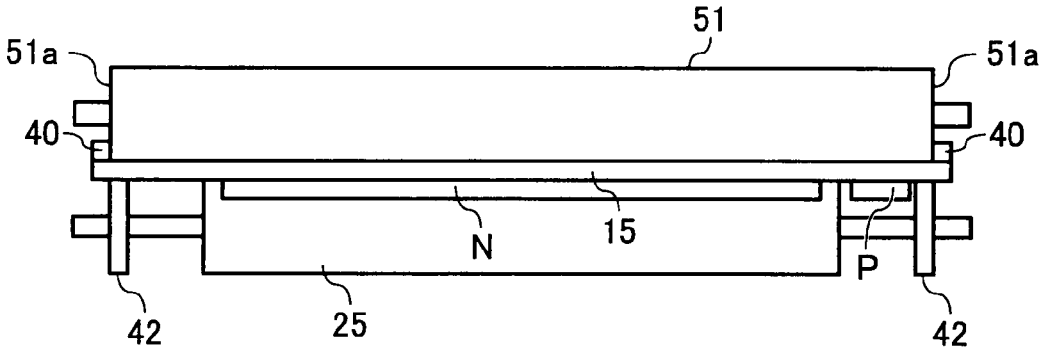
FIG. 11 is a configuration diagram of another secondary fixing nip position.

As shown in FIG. 11, the patch-pattern forming area is sandwiched at both outer sides of the secondary transfer roller 25 in the width direction, and is pressed against both ends of the intermediate transfer belt 15 in the width direction. For example, a roller-shaped contact part 42 can be provided. The patch-pattern forming area is sandwiched at both outer sides of the secondary transfer roller 25 in the width direction, and the contact part 42 is pressed against each end of the intermediate transfer belt 15 in the width direction. Along the running of the intermediate transfer belt 15, the secondary transfer roller 25 is rotated together with the secondary transfer backup roller 51. With this arrangement, a deviation of the intermediate transfer belt 15 to a single side is prevented, color misregistration is avoided, and the occurrence of an abnormal image such as a slip track can be avoided, thereby preventing reduction in the image quality. Particularly, because the contact part 42 is pressed against both ends of the intermediate transfer belt 15 in the width direction not adhered with toners, slip can be prevented, and the occurrence of an image failure due to the poor secondary transfer attributable to the slip can be avoided.

To prevent the separation of the intermediate transfer belt 15, the belt tension can be increased. However, this increases load of the intermediate transfer belt 15, and the intermediate transfer belt 15 is easily curled, resulting in the cause of an abnormal image. Therefore, it is not desirable to increase tension too much. In the above example, the secondary transfer roller 25 is rotated along the rotation of the intermediate transfer belt 15. As is clear from FIG. 11, there is an area which is contacted at the belt end part where toners and the transfer material N are not present. Therefore, the secondary transfer roller 25 does not slip due to the toners and the transfer material N, and an image has no problem.

Figure 12:
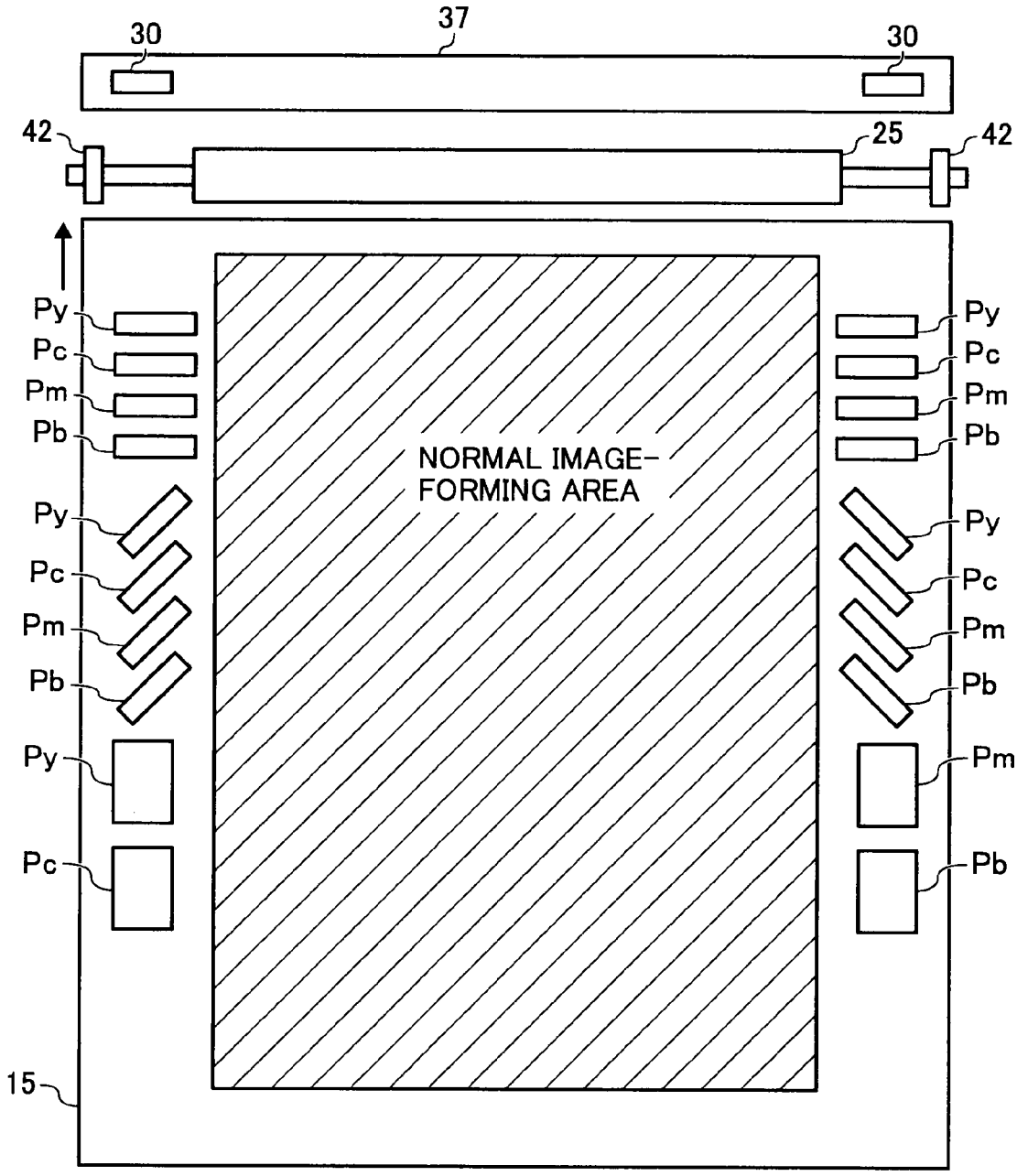
FIG. 12 is an example of a positional relationship between an intermediate transfer belt, a secondary transfer roller, and reflection-type photosensors, where two reflection-type photosensors are arranged.
Figure 13:
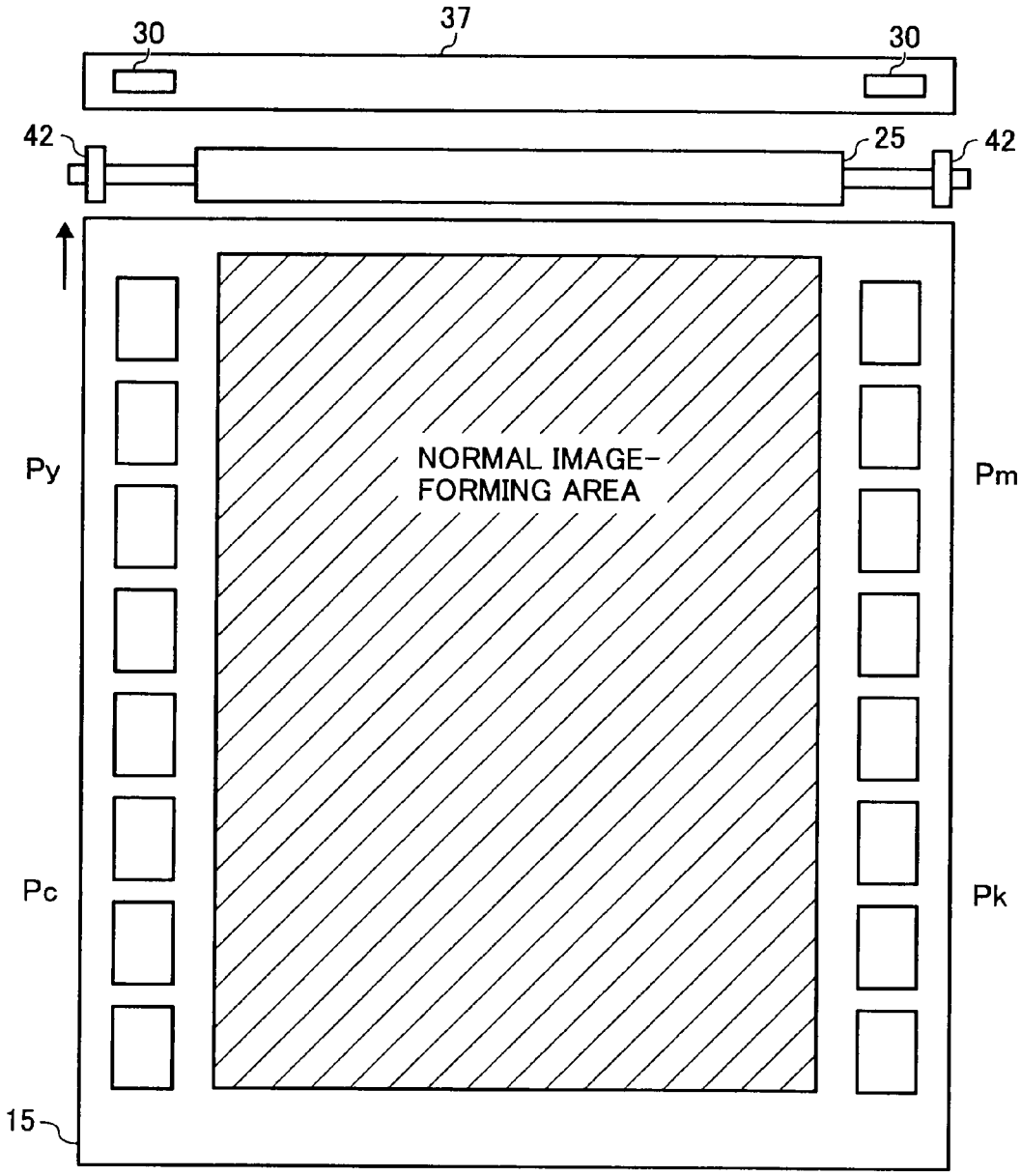
FIG. 13 is another example of a positional relationship between an intermediate transfer belt, a secondary transfer roller, and reflection-type photosensors, where two reflection-type photosensors are arranged.

FIG. 12 and FIG. 13 are examples where two reflection-type photosensors 30 are disposed.

While one reflection-type photosensor 30 is disposed in the above examples, two reflection-type photosensors 30 can be supported by the supporting member 37, and can be disposed such that the secondary transfer roller 25 is not contacted to the patch patterns, as shown in FIG. 12 and FIG. 13. Based on the above configuration, patterns can be detected at a high speed, and a positional control can be carried out by detecting a positional deviation amount of each color at both sides. In the example shown in FIG. 12, positioning patterns are first prepared, and concentration patterns are prepared. FIG. 13 depicts a state where four gradation patterns of each color are imaged in parallel.

Figure 14:
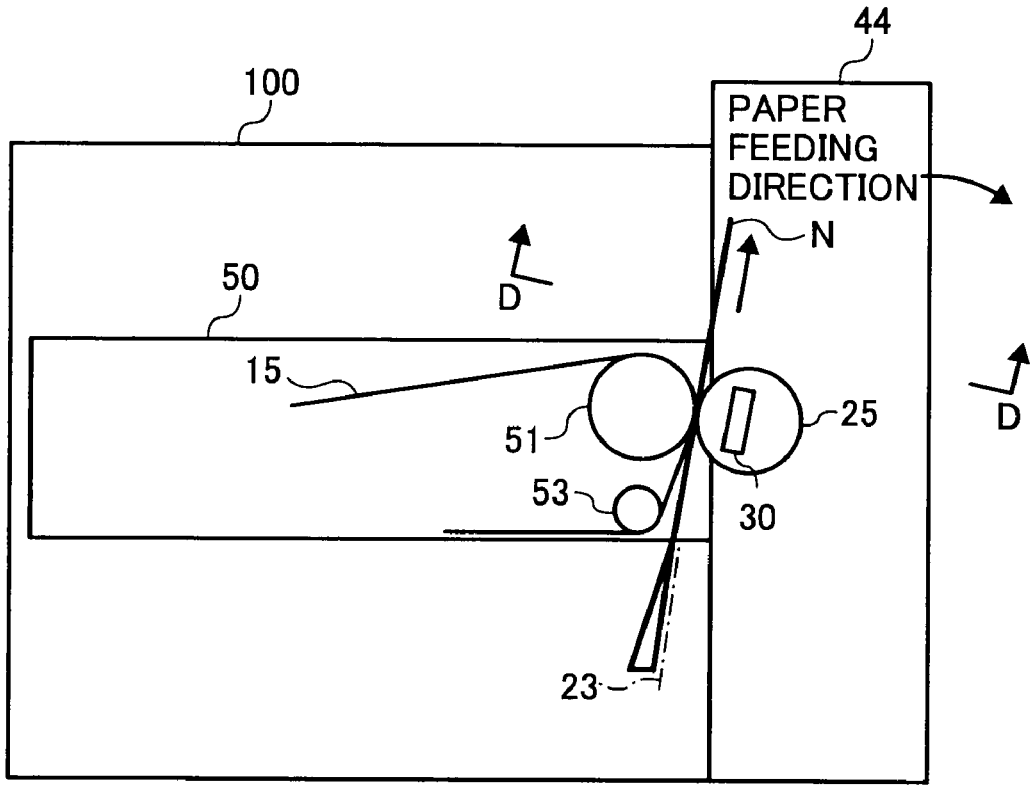
FIG. 14 is a schematic configuration diagram near a secondary transfer position in another image forming apparatus.

FIG. 14 depicts a schematic configuration of a part near a secondary transfer position in another image forming apparatus.

As is clear from FIG. 14, in this example, the width of an image forming area is designed larger than the width of a maximum transfer size. The width (a direction orthogonal with the moving direction) A of the intermediate transfer belt 15, the total width B of the area in which the secondary transfer roller 25 is contacted to the intermediate transfer belt 15, and the maximum width C of the transfer material N have a relationship of A>B>C. The patch pattern P is formed in a patch-pattern forming area (A-B) in which the secondary transfer roller 25 is not brought into contact. The reflection-type photosensor 30 is provided at the outside of the transfer-material carrying path 23 opposite to the secondary transfer backup roller 51.

The secondary transfer roller 25 is supported by a cover 44 provided in an openable and closable manner in the apparatus main body 100. When the cover 44 of the apparatus main body 100 is opened in an arrowhead direction, the secondary transfer roller 25 supported by the cover 44 is separated from the intermediate transfer belt 15. When the cover 44 is opened, the transfer-material carrying path 23 is released, and a jam processing is facilitated at the secondary transfer position.

In this way, the apparatus main body 100 is separately provided from the cover 44, that is, the secondary transfer roller 25 is separately provided from the apparatus main body 100. Therefore, when the secondary transfer roller 25 has a cleaning mechanism, a waste toner tank needs to be separately provided from the apparatus main body 100. Accordingly, cost, space, and room are additionally required. However, in this example, because the patch pattern P is formed in the patch-pattern forming area which is not contacted to the secondary transfer roller 25, there is no risk that the toners forming the patch pattern P are adhered to the secondary transfer roller 25. A cleaning mechanism that cleans the secondary transfer roller 25 does not need to be provided. Consequently, the above problems can be solved.

Figure 15:
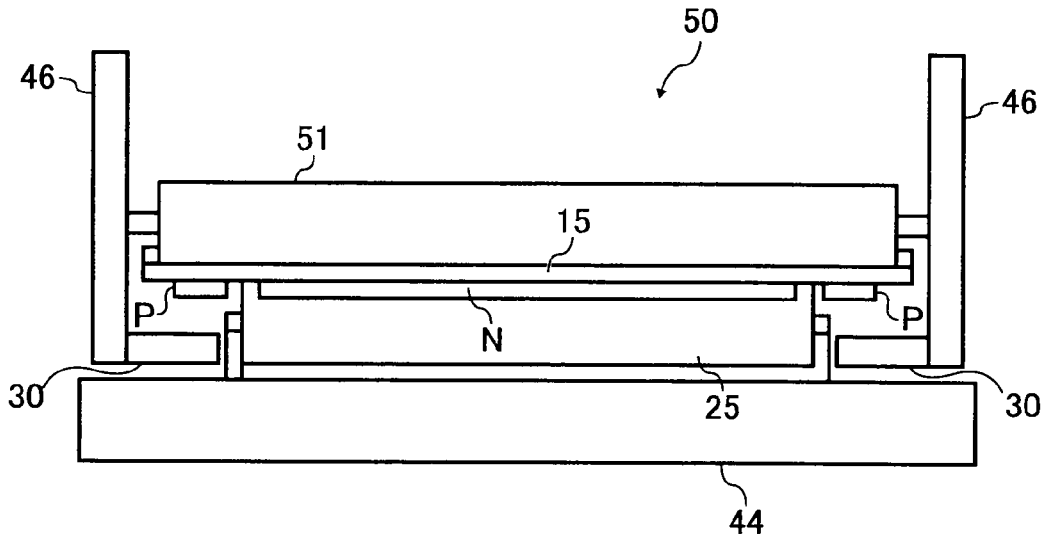
FIG. 15 is a cross-section taken along line D-D in FIG. 14.

FIG. 15 is a cross-section taken along line D-D in FIG. 14.

As shown in FIG. 15, the cover 44 can be opened in an arrowhead direction. The patch pattern P can be imaged at the outer side of the transfer-material carrying path 23 and the secondary transfer roller 25 in the width direction. The reflection-type photosensor 30 can be also disposed at an uninterfered position.

A distance between the reflection-type photosensor 30 and the opposite intermediate transfer belt 15 needs to be limited to within a predetermined range. This is because the reflection light amount of the reflection-type photosensor 30 is different depending on this distance, and this becomes a detection error. In the example shown in FIG. 14 and FIG. 15, the intermediate transfer belt 15 is applied to the rollers 51 to 53 to form a unit configuration. The intermediate transfer belt 15 is supported by a unit side plate 46 of the intermediate transfer unit 50, and the intermediate transfer unit 50 has the reflection-type photosensor 30. In the intermediate transfer unit 50, the intermediate transfer belt 15 and the reflection-type photosensor 30 are combined together on the unit side plate 46 of the same member. With this arrangement, a variation of a distance between the patch pattern P on the intermediate transfer belt 15 and the reflection-type photosensor 30 is minimized to make it possible to stably detect image information.

Figure 16:
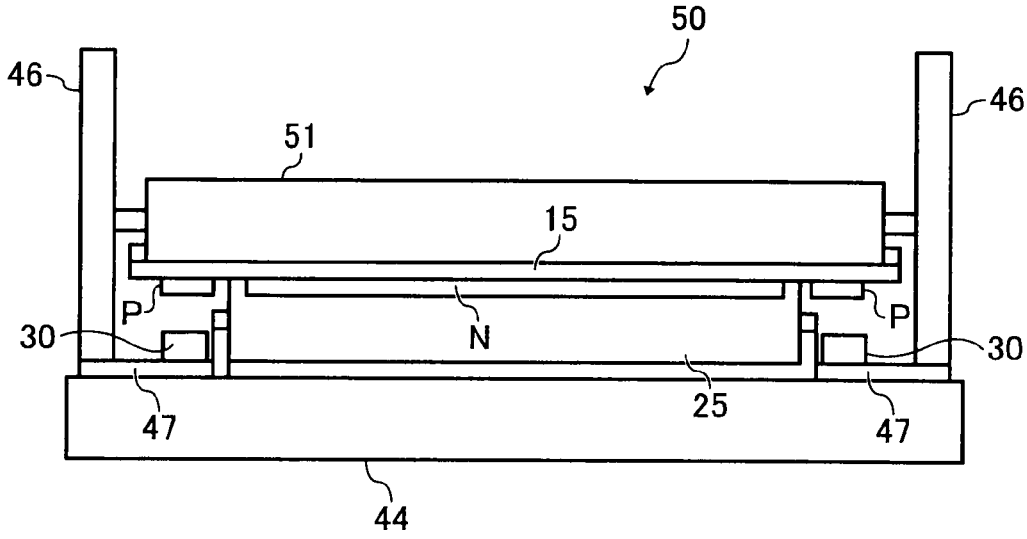
FIG. 16 depicts another supporting configuration of the reflection-type photosensor.
Figure 17:
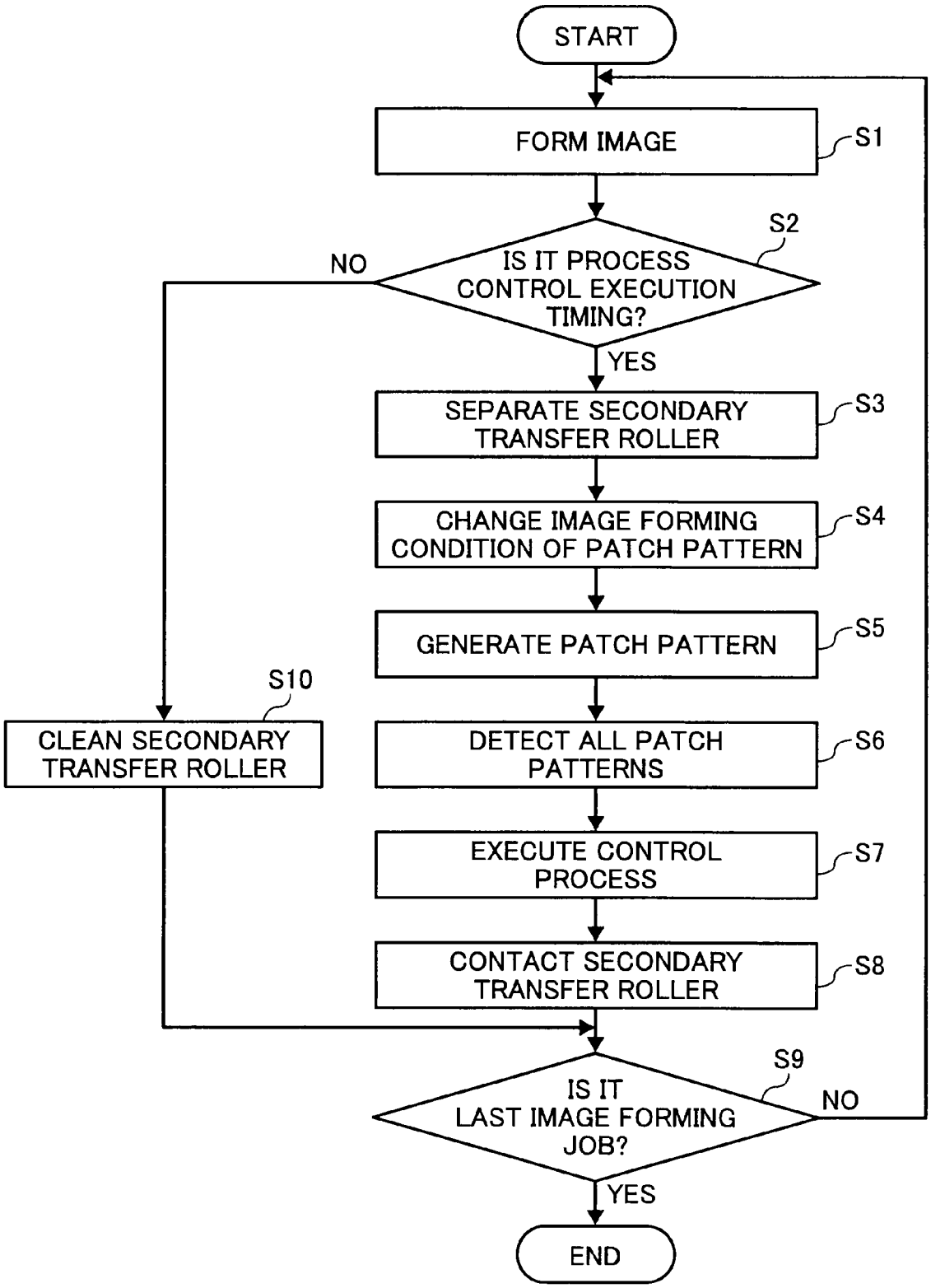
FIG. 17 is a flowchart of a process of detecting concentration and a position of an image using a conventional patch pattern.
Figure 18:
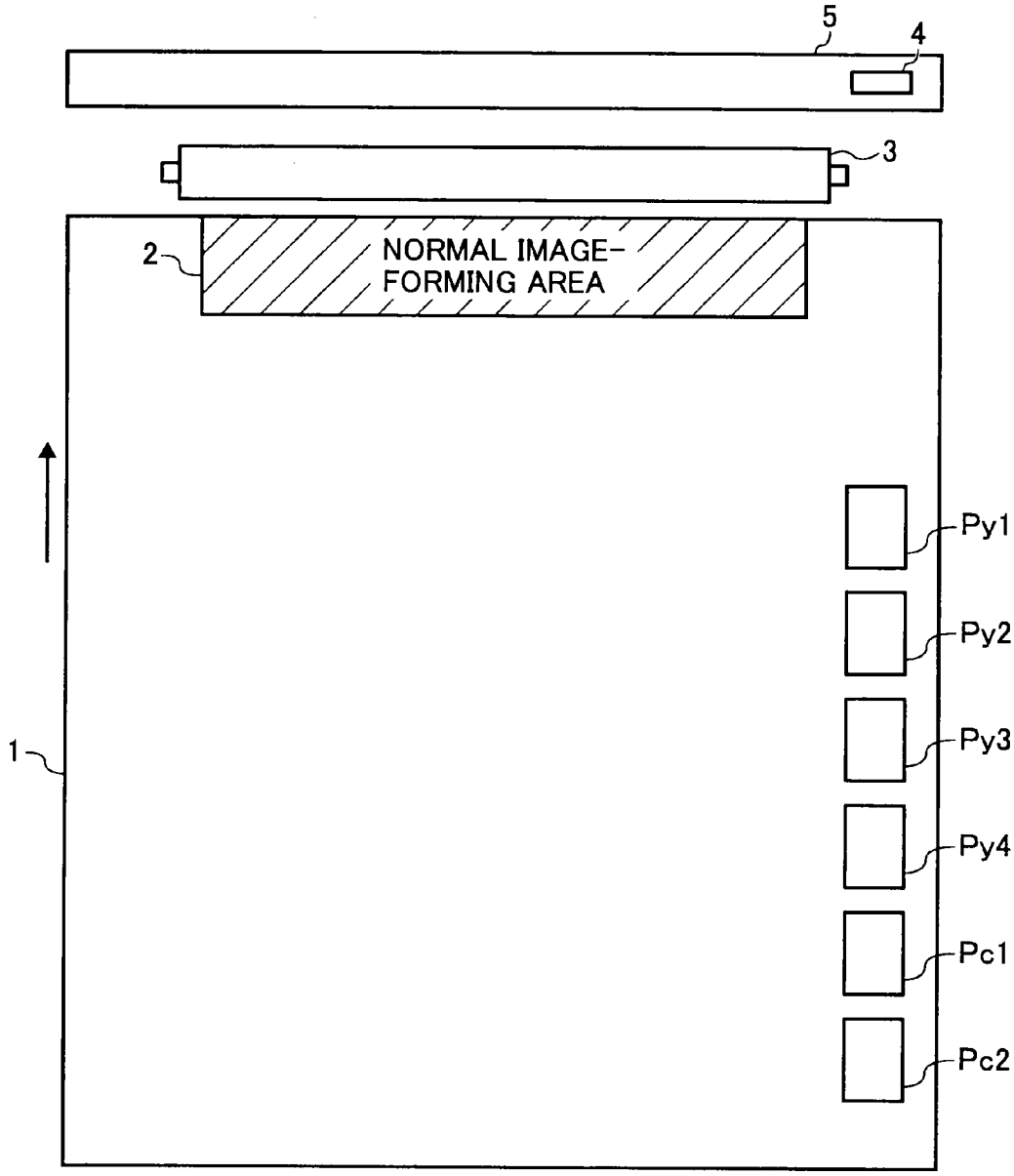
FIG. 18 is a pattern layout diagram of the conventional patch pattern.

FIG. 16 depicts another supporting configuration of the reflection-type photosensor 30.

In the example shown in FIG. 16, the intermediate transfer belt 15 is formed in a unit configuration. The cover 44 which is contacted to the intermediate transfer unit 50 in a closed state is provided in an openable and closable manner in the apparatus main body 100. The reflection-type photosensor 30 is supported by the cover 44. When the cover 44 is closed, the cover 44 is brought into contact with the intermediate transfer unit 50, and a point between the cover 44 that supports the reflection-type photosensor 30 and the intermediate transfer unit 50 in which the intermediate transfer belt 15 is provided is positioned.

In other words, the cover 44 supports the reflection-type photosensor 30 like the secondary transfer roller 25. However, when the reflection-type photosensor 30 is simply covered by the cover 44, a distance between the intermediate transfer belt 15 and the reflection-type photosensor 30 cannot be kept constant, as described above. Therefore, in this example, the cover 44 has a positioning contact member 47 to keep a constant distance between the reflection-type photosensor 30 and the secondary transfer roller 25. This positioning contact member 47 is brought into contact with the unit side plate 46 when the cover 44 is closed, thereby maintaining this distance. Positions of the intermediate transfer unit 50 and the secondary transfer roller 25 are determined by the contact point between the positioning contact member 47 and the unit side plate 46. Therefore, the distance between the reflection-type photosensor 30 and the intermediate transfer belt 15 can be easily maintained.

In this example, the reflection-type photosensor 30 is opened and closed together with the cover 44. Therefore, when the reflection-type photosensor 30 is stained with a scattering toner, the cover 44 can be opened cleaned, thereby enabling a user to easily carry out maintenance work.

The process condition of each member used in the above example is as follows.

An organic photoconductor (OPC) is used for the photoconductors 11*y*, 11*c*, 11*m*, and 11*b*. A charged roller is used close to or in contact with the photoconductor for the charging units 12*y*, 12*c*, 12*m*, and 12*b*, thereby uniformly charging at −200 to −2,000 volts. The laser beams Ly, Lc, Lm, Lb corresponding to a draft image are applied to the photoconductors 11*y*, 11*c*, 11*m*, and 11*b* to form an electrostatic latent image.

Negatively-charged toners are used to carry out a negative-positive development, thereby visibly process the electrostatic latent image to form a toner image. A thermosetting resin having a thickness of 0.10 millimeter, a width of 266 millimeters, and an internal peripheral length of 796 millimeters is used as the intermediate transfer belt 15. A moving speed is set to 150 mm/sec. The positional-deviation preventing member 40 having a width of 5 millimeters and a height of 2.5 millimeters is stitched to both sides of the back surface of the intermediate transfer belt 15. A maximum transfer sheet size is that of a longitudinal sheet of LT, and a maximum width is 216 millimeters.

Based on the above condition, total volume resistivity of the intermediate transfer belt 15 obtained is 107 to 1,012 Ωcm. The volume resistivity is a result of applying a voltage 100 volts for tens seconds using a measuring method described in JIS K 6911. Surface resistivity of the intermediate transfer belt 15 is measured as 109 to 1,014 Ω/□ by a resistivity meter "Hiresta IP" (Mitsubishi Petrochemical Co., Ltd.). In addition to this resistivity meter, a surface resistance measuring method described in JIS K 6911 can be also used. A roller made of foamed polyurethane resin having a diameter of 26 millimeters and a width of 226 millimeters is used for the secondary transfer roller 25.

According to an embodiment of the present invention, a patch-pattern forming area is provided in an area of the intermediate transfer unit not contacted by the secondary transfer unit. A patch pattern is formed in the patch-pattern forming area at suitable timing. An optical detector detects the patch pattern to detect image concentration and a position. Various kinds of image formation parameters such as a charge characteristic of an image carrier, a charge characteristic affecting the adhesiveness of the toners in the developing material, and a development bias characteristic controlling the toner adhesion amount are feedback-controlled. Therefore, even when the secondary transfer unit is not separated from the intermediate transfer unit, the patch pattern formed in the intermediate transfer unit is not adhered to the secondary transfer unit. Time required to detect the patch pattern is decreased by the time taken to separate the secondary transfer unit. Precision can be increased, and oscillation of the transfer unit affecting the detection precision can be suppressed. Moreover, all patch patterns of each color can be securely formed. Consequently, a compact and low-cost image forming apparatus can be provided.

According to another embodiment of the present invention, the intermediate transfer unit as an intermediate transfer belt is symmetrically applied to the member opposing the secondary transfer unit. The secondary transfer unit is symmetrically contacted to the intermediate transfer unit. Along the running of the intermediate transfer unit, the secondary transfer unit is rotated together with the secondary transfer unit. Therefore, a deviation of the intermediate transfer unit to a width direction can be prevented by uniformly applying load to the intermediate transfer unit as an intermediate transfer belt. Furthermore, color misregistration and the occurrence of an abnormal image due to a slip track can be avoided, thereby preventing reduction in the image quality.

According to still another embodiment of the present invention, in running the intermediate transfer unit, the positional-deviation preventing member provided along both edge of the intermediate transfer unit is applied to both end surfaces of the member facing the secondary transfer unit, thereby preventing the deviation of the intermediate transfer unit applied to the member opposite to the secondary transfer unit. Therefore, a deviation of the intermediate transfer unit can be prevented. Moreover, color misregistration and the occurrence of an abnormal image due to a slip track can be avoided, thereby preventing reduction in the image quality.

According to still another embodiment of the present invention, a patch-pattern forming area is sandwiched between both outer sides of the secondary transfer unit in the width direction. A contact part is pressed against each end of the intermediate transfer unit in the width direction. Along the running of the intermediate transfer unit, the secondary transfer unit is rotated together with the member opposite to the secondary transfer unit. Therefore, a deviation of the intermediate transfer unit can be prevented. Furthermore, color misregistration and the occurrence of an abnormal image due to a slip track can be avoided, thereby preventing reduction in the image quality. Particularly, because the contact part is pressed against both ends of the intermediate transfer belt in the width direction not adhered with toners, slip can be prevented, and the occurrence of an image failure due to the poor secondary transfer attributable to the slip can be avoided.

According to still another embodiment of the present invention, when a patch pattern is formed in the patch-pattern forming area of the intermediate transfer unit, an optical detector detects the patch pattern after passing through the secondary transfer nip. Therefore, design room can be provided in disposing the optical detector. In the downstream of the secondary transfer nip, image information can be detected in high precision.

According to still another embodiment of the present invention, when the cover is opened from the image forming apparatus, the secondary transfer unit supported by the cover is released from the intermediate transfer unit. Therefore, by opening the cover, the transfer material carrying path can be released, and the jam processing at the secondary transfer position can be facilitated.

According to still another embodiment of the present invention, in the intermediate transfer unit, the intermediate transfer unit and the optical detector are combined together on the same member. Therefore, a variation of a distance between the patch pattern on the intermediate transfer unit and the optical detector is minimized to make it possible to stably detect image information.

According to still another embodiment of the present invention, when the cover is closed, the cover is brought into contact with the intermediate transfer unit. A point between the cover that supports the optical detector and the intermediate transfer unit in which the intermediate transfer unit is provided is positioned. Therefore, a variation in the distance between the patch pattern on the intermediate transfer unit and the optical detector can be decreased, and image information can be detected stably. Because the optical detector is supported by the cover, the stain of the optical detector can be easily cleaned by opening the cover, thereby facilitating the maintenance work.

Although the invention has been described with respect to a specific embodiment for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus comprising:

an intermediate transfer member;

a primary transfer member configured to primarily transfer an image formed on an image carrier onto a surface of the intermediate transfer member;

a secondary transfer member configured to secondarily transfer the image on the intermediate transfer member onto a transfer material, the secondary transfer member being in contact with the intermediate transfer member; and contact members attached to outer ends of the secondary transfer member in the axial direction, wherein a relation A>B>C is satisfied, where A is a width of the intermediate transfer member, B is a width of the secondary transfer member, and C is a width of the transfer material that passes between the intermediate transfer member and the secondary transfer member, wherein the surface of the intermediate transfer member includes an image forming area, a contact area, and a patch-pattern forming area, such that the patch pattern forming area is not contacted by the secondary transfer member, wherein the contact area is formed along edges of the intermediate transfer member, wherein the patch pattern forming area is located between the contact area and the image forming area, wherein the contact members are configured to press against the contact area of the intermediate transfer member, and wherein the image forming apparatus further comprises an optical detector configured to detect a patch pattern formed in the patch-pattern forming area by the primary transferring member.

2. The image forming apparatus according to claim 1, wherein the intermediate transfer member is an endless belt that is supported on an opposing member facing the secondary transfer member, and the secondary transfer member is arranged such that center of the secondary transfer member aligns with center of the opposing member in a width direction.

3. The image forming apparatus according to claim 2, further comprising positional-deviation preventing members that are arranged along both edges of the intermediate transfer member, and contact both edges of the opposing member.

4. The image forming apparatus according to claim 1, wherein the optical detector is located downstream of a secondary nip formed between the intermediate transfer member and the secondary transfer member in a moving direction of the intermediate transfer member.

5. The image forming apparatus according to claim 1, further comprising a cover that is openable and closable, and supports the secondary transfer member.

6. The image forming apparatus according to claim 1, wherein the optical detector is provided in an intermediate transfer unit that includes the intermediate transfer member.

7. The image forming apparatus according to claim 1, further comprising an openable and closable cover that is brought into contact with an intermediate transfer unit that includes the intermediate transfer member when closed, and wherein the openable and closable cover supports the optical detector.

8. The image forming apparatus according to claim 1, wherein the contact members are cylindrically shaped, and wherein a radius of the contact members is equal to a radius of the secondary transfer member.

9. The image forming apparatus according to claim 1, wherein the image forming area is located along a center line of the intermediate transfer member and extends outwardly from the center line a distance of C/2 in both a positive width direction and a negative width direction, wherein a first portion of the patch pattern forming area is located beyond the image forming area in the positive width direction and a second portion of the patch pattern forming area is located beyond the image forming area in the negative width direction, and wherein a first portion of the contact area is located beyond the first portion of the patch pattern forming area in the positive width direction and a second portion of the contact area is located beyond the second portion of the patch pattern forming area in the negative width direction.

10. An image forming method that is applied to an image forming apparatus including an image carrier, an intermediate transfer member, a primary transfer member, a secondary transfer member, and an optical detector, the image forming method comprising:

transferring an image formed on the image carrier onto a surface of the intermediate transfer member via the primary transfer member; and transferring the image on the intermediate transfer member onto a transfer material via the secondary transfer member, the secondary transfer member being in contact with the intermediate transfer member, wherein a relation A>B>C is satisfied, where A is a width of the intermediate transfer member, B is a width of the secondary transfer member, and C is a width of the transfer material that passes through between the intermediate transfer member and the secondary transfer member, wherein the surface of the intermediate transfer member includes an image forming area, a contact area, and a patch-pattern forming area, such that the patch pattern forming area is not contacted by the secondary transfer member, wherein the contact area is formed along edges of the intermediate transfer member, wherein the patch pattern forming area is located between the contact area and the image forming area, wherein contact members are attached at outer ends of the secondary transfer member in the axial direction, such that during the transferring the image on the intermediate transfer member onto the transfer material the contact members press against the contact area of the intermediate transfer member, and wherein the image forming method further comprising the optical detector detecting a patch pattern formed in the patch-pattern forming area by the primary transferring member.

11. The image forming method according to claim 10, wherein the intermediate transfer member is an endless belt that is supported on an opposing member facing the secondary transfer member, and the secondary transfer member is arranged such that center of the secondary transfer member aligns with center of the opposing member in a width direction.

12. The image forming method according to claim 11, further comprising preventing positional deviation by positional-deviation preventing members that are arranged along both edges of the intermediate transfer member, and contact both edges of the opposing member.

13. The image forming method according to claim 10, wherein the optical detector is located downstream of a secondary nip formed between the intermediate transfer member and the secondary transfer member in a moving direction of the intermediate transfer member.

14. The image forming method according to claim 10, further comprising supporting the secondary transfer member by a cover that is openable and closable.

15. The image forming method according to claim 10, wherein the optical detector is provided in an intermediate transfer unit that includes the intermediate transfer member.

16. The image forming method according to claim 10, further comprising supporting the optical detector by an openable and closable cover that is brought into contact with an intermediate transfer unit that includes the intermediate transfer member when closed.

17. The image forming method according to claim 10, wherein the contact members are cylindrically shaped, and wherein a radius of the contact members is equal to a radius of the secondary transfer member.

18. The image forming apparatus according to claim 10, wherein the image forming area is located along a center line of the intermediate transfer member and extends outwardly from the center line a distance of C/2 in both a positive width direction and a negative width direction, wherein a first portion of the patch pattern forming area is located beyond the image forming area in the positive width direction and a second portion of the patch pattern forming area is located beyond the image forming area in the negative width direction, and wherein a first portion of the contact area is located beyond the first portion of the patch pattern forming area in the positive width direction and a second portion of the contact area is located beyond the second portion of the patch pattern forming area in the negative width direction.

* * * * *